US008837747B2

(12) United States Patent
Suzuki

(10) Patent No.: US 8,837,747 B2
(45) Date of Patent: Sep. 16, 2014

(54) APPARATUS, METHOD, AND PROGRAM PRODUCT FOR PRESENTING MOVING IMAGE WITH SOUND

(75) Inventor: Kaoru Suzuki, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 413 days.

(21) Appl. No.: 13/189,657

(22) Filed: Jul. 25, 2011

(65) Prior Publication Data

US 2012/0076304 A1 Mar. 29, 2012

(30) Foreign Application Priority Data

Sep. 28, 2010 (JP) ..... 2010-217568

(51) Int. Cl.
*H04R 3/00* (2006.01)
*H04S 7/00* (2006.01)

(52) U.S. Cl.
CPC ..... *H04S 7/30* (2013.01); *H04S 2400/15* (2013.01); *H04S 2400/11* (2013.01); *H04S 2420/01* (2013.01); *H04R 2430/23* (2013.01)
USPC ..... 381/92; 381/122; 381/306; 348/231.4

(58) Field of Classification Search
USPC ..... 381/91–92, 22–23, 17, 306, 333, 388; 348/14.08, 14.16, 231.4
See application file for complete search history.

(56) References Cited

U.S. PATENT DOCUMENTS 7,711,127 B2 5/2010 Suzuki et al.
2006/0204019 A1 9/2006 Suzuki et al.
2008/0089531 A1 4/2008 Koga et al.
2012/0013768 A1* 1/2012 Zurek et al. ..... 348/231.4
2012/0163606 A1* 6/2012 Eronen et al. ..... 381/22

FOREIGN PATENT DOCUMENTS

| | | |
|---|---|---|
| JP | 11041687 | 2/1999 |
| JP | 2005-124090 | 5/2005 |
| JP | 2006222618 | 8/2006 |
| JP | 2006287544 | 10/2006 |
| JP | 2009-156888 | 7/2009 |
| JP | 2010-154259 | 7/2010 |

OTHER PUBLICATIONS

Japanese Office Action for Japanese Application No. 2010-217568 mailed on Sep. 11, 2012.

* cited by examiner

*Primary Examiner* — Disler Paul
(74) *Attorney, Agent, or Firm* — Amin, Turocy & Watson, LLP

(57) ABSTRACT

According to one embodiment, an apparatus for presenting a moving image with sound includes an input unit, a setting unit, a main beam former unit, and an output control unit. The input unit inputs data on a moving image with sound including a moving image and a plurality of channels of sounds. The setting unit sets an arrival time difference according to a user operation, the arrival time difference being a difference in time between a plurality of channels of sounds coming from a desired direction. The main beam former unit generates a directional sound in which a sound in a direction having the arrival time difference set by the setting unit is enhanced, from the plurality of channels of sounds included in the data on the moving image with sound. The output control unit outputs the directional sound along with the moving image.

10 Claims, 20 Drawing Sheets

FIG.2A SOUND COMING FROM FRONT
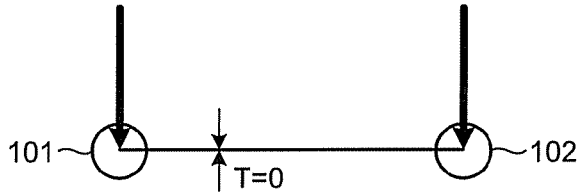
FIG.2B SOUND COMING DIRECTLY FROM SIDE (RIGHT)
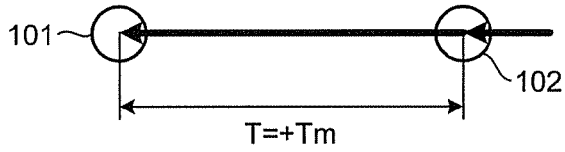
FIG.2C SOUND COMING DIRECTLY FROM SIDE (LEFT)
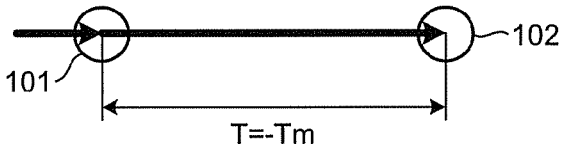
FIG.2D SOUND COMING OBLIQUELY (GENERAL SOLUTION)
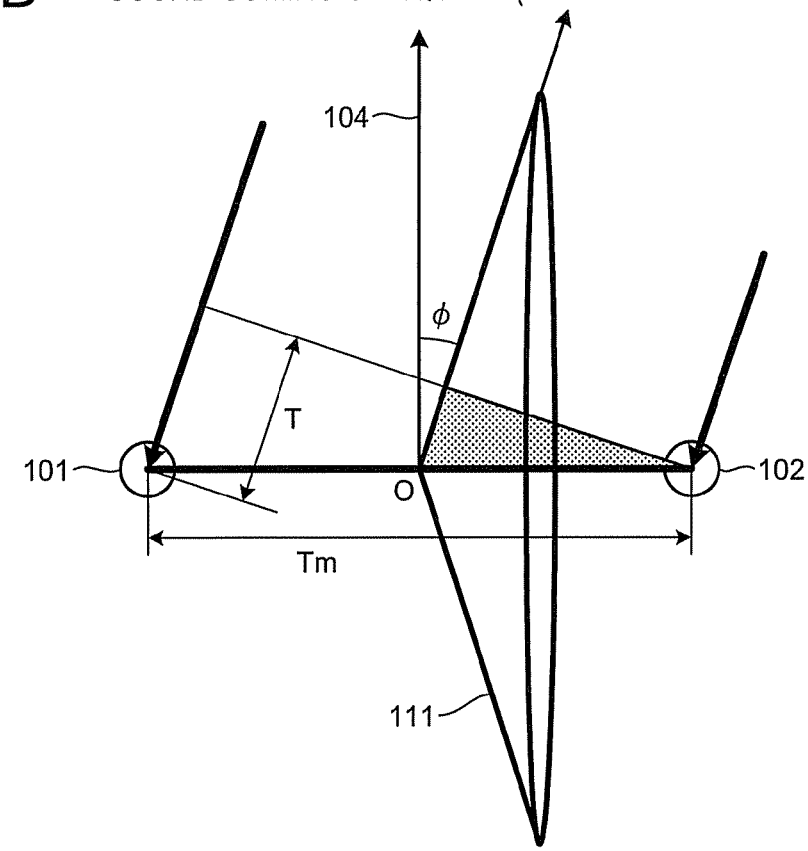

APPARATUS, METHOD, AND PROGRAM PRODUCT FOR PRESENTING MOVING IMAGE WITH SOUND

CROSS-REFERENCE TO RELATED APPLICATIONS

This application is based upon and claims the benefit of priority from Japanese Patent Application No. 2010-217568, filed on Sep. 28, 2010; the entire contents of which are incorporated herein by reference.

FIELD

Embodiments described herein relate generally to an apparatus, method, and program product for presenting a moving image with sound.

BACKGROUND

A technology has conventionally been proposed in which, during or after shooting of a moving image with sound, sound issued from a desired subject is enhanced to be output. The sound includes a plurality of channels of sounds simultaneously recorded by a plurality of microphones. According to the conventional technology, when a user specifies a desired subject in a displayed image, a directional sound in which the sound issued from the specified subject is enhanced is generated and output. It is required that information on the focal length of an imaging apparatus at the time of shooting and information on the arrangement of the plurality of microphones (microphone-to-microphone distance) are known in advance.

In accordance with the universal prevalence of imaging apparatuses such as home movie cameras for shooting a moving image with stereo sound, huge amounts of data on moving images with sound that are shot by such imaging apparatuses are available, and demands for replay are ever on the increase. In many of these moving images with sound, the information on the focal length of the imaging apparatus at the time of shooting and the information on the microphone-to-microphone distance are unknown.

The conventional technology requires that the information on the focal length of the imaging apparatus at the time of shooting and the information on the microphone-to-microphone distance are known in advance. Thus, sound issued from a desired subject when replaying a moving image with sound, in which the information on the focal length of the imaging apparatus at the time of shooting and the information on the microphone-to-microphone distance are unknown, cannot be enhanced to be output.

BRIEF DESCRIPTION OF THE DRAWINGS

FIGS. 2A to 2D are diagrams explaining acoustic directivity;

DETAILED DESCRIPTION

In general, according to one embodiment, an apparatus for presenting a moving image with sound includes an input unit, a setting unit, a main beam former unit, and an output control unit. The input unit inputs data on a moving image with sound including a moving image and a plurality of channels of sounds. The setting unit sets an arrival time difference according to a user operation, the arrival time difference being a difference in time between a plurality of channels of sounds coming from a desired direction. The main beam former unit generates a directional sound in which a sound in a direction having the arrival time difference set by the setting unit is enhanced, from the plurality of channels of sounds included in the data on the moving image with sound. The output control unit outputs the directional sound along with the moving image.

Embodiments to be described below are configured such that a user can watch a moving image and listen to a directional sound in which sound from a desired subject is enhanced, even with existing contents (moving image with sound) for which information on the focal length f at the time of shooting and information on the microphone-to-microphone distance d are not available. Examples of the moving image with sound include contents that are shot by a home movie camera and the like for shooting a moving image with stereo sound (such as AVI, MPEG-1, MPEG-2, MPEG-4) and secondary products thereof. In such moving images with sound, the details of the imaging apparatus including the focal length f at the time of shooting and the microphone-to-microphone distance d of the stereo microphones are unknown.

Figure 1:
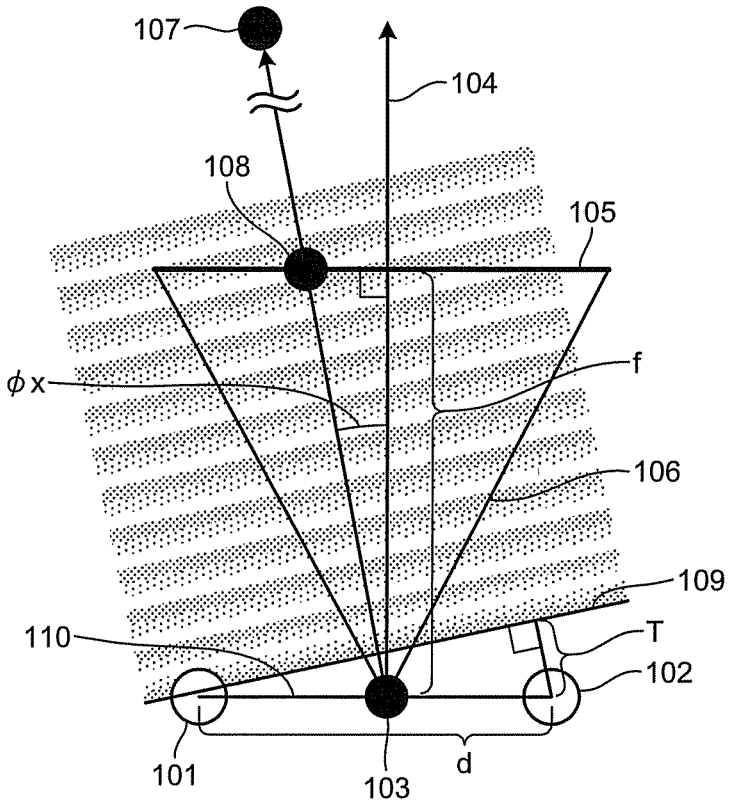
FIG. 1 is a top view showing the relationship between an acoustic system and an optical system of an imaging apparatus by which a moving image with sound is shot.

Several assumptions will be made as to the shooting situation. FIG. 1 is a top view showing the relationship between an acoustic system and an optical system of an imaging apparatus for shooting a moving image with sound. FIGS. 2A to 2D are diagrams explaining acoustic directivity. Suppose, as shown in FIG. 1, that an array microphone of the acoustic system is composed of two microphones 101 and 102 which are arranged horizontally at a distance d from each other. The imaging system will be considered by a pinhole camera model where an imaging plane 105 perpendicular to an optical axis 104 lies in a position a focal length f away from a focal point 103. The acoustic system and the imaging system have a positional relationship such that the optical axis 104 of the imaging system is generally perpendicular to a baseline 110 that connects the two microphones 101 and 102. As compared to the distance to a subject 107 (1 m or more), the microphone-to-microphone distance d between the microphones 101 and 102 (around several centimeters) is so close to the imaging system that the midpoint of the baseline 110 and the focal point 103 are assumed to fall on the same position.

Suppose that the subject 107 which lies in an imaging range 106 of the imaging system appears as a subject image 108 on the imaging plane 105. With the position on the imaging plane 105 where the optical axis 104 passes as the origin point, the horizontal coordinate value and the vertical coordinate value of the subject image 108 on the imaging plane 105 will be assumed to be x1 and y1, respectively. From the coordinate values (x1, y1) of the subject image 108, the horizontal direction $\phi x$ of the subject 107 is determined by equation (1) seen below. The vertical direction $\phi y$ of the subject 107 is determined by equation (2) seen below. $\phi x$ and $\phi y$ are signed quantities with the directions of the x-axis and y-axis as positive, respectively.

$$\phi x=\tan^{-1}(x1/f) \tag{1}$$

$$\phi y=\tan^{-1}(y1/f) \tag{2}$$

Given that the subject 107 is at a sufficiently large distance, sound that comes from the subject 107 to the two microphones 101 and 102 can be regarded as plane waves. A wave front 109 reaches each of the microphones 101 and 102 with an arrival time difference T according to the coming direction of the sound. The relationship between the arrival time difference T and the coming direction $\phi$ is expressed by equation (3) seen below. d is the microphone-to-microphone distance, and Vs is the velocity of sound. Note that $\phi$ is a signed quantity with the direction from the microphone 101 to the microphone 102 as positive.

$$\phi=\sin^{-1}(T\cdot Vs/d)\rightarrow T=d\cdot\sin(\phi)/Vs \tag{3}$$

As shown in FIG. 2D, sound sources having the same arrival time difference T fall on a surface 111 (a conical surface unless $\phi$ is 0° or ±90°) that forms an angle $\phi$ from the front direction of the microphones 101 and 102 (the direction of the optical axis 104 based on the foregoing assumption). That is, the sound having the arrival time difference T consists of all sounds that come from on the surface (sound source existing range) 111. Hereinafter, the surface 111 will be referred to as an acoustic directivity center and the coming direction $\phi$ as a directivity angle when the directivity of the array microphone is directed to the sound source existing range 111. Tm in the diagram is a function of the microphone-to-microphone distance d, and represents the theoretical maximum value of the arrival time difference calculated by equation (4) seen below. As shown in FIGS. 2A to 2C, the arrival time difference T is a signed quantity in the range of $-Tm\leq T\leq Tm$.

$$Tm=d/Vs \tag{4}$$

The acoustic directivity center forms an image (hereinafter, referred to as an acoustic directivity center image) on the imaging plane 105, in the position where the surface (sound source existing range) 111 and the imaging plane 105 intersect each other. When $\phi=0°$, the acoustic directivity center image coincides with the y-axis of the imaging plane 105. When $\phi=\pm 90°$, there is no acoustic directivity center image. When $0°<|\phi|<90°$, the acoustic directivity center image can be determined as a quadratic curve expressed by the third equation of equation (5) seen below. In the following equation (5), ○ shown in FIG. 2D is taken as the origin point. The axis from the microphone 101 to the microphone 102 is the x-axis (which is assumed to be parallel to the x-axis of the imaging plane 105). The axis perpendicular to the plane of FIGS. 2A to 2D is the y-axis (which is assumed to be parallel to the y-axis of the imaging plane 105). The direction of the optical axis 104 is the z-axis.

$y^2+z^2=x^2\cdot\tan^2(\phi)$, and: the equation of the surface (sound source existing range) 111 z=f: the constraint that the image be on the imaging plane 105

$$\rightarrow y^2=x^2\cdot\tan^2(\phi)-f^2 \tag{5}$$

Figure 3A:
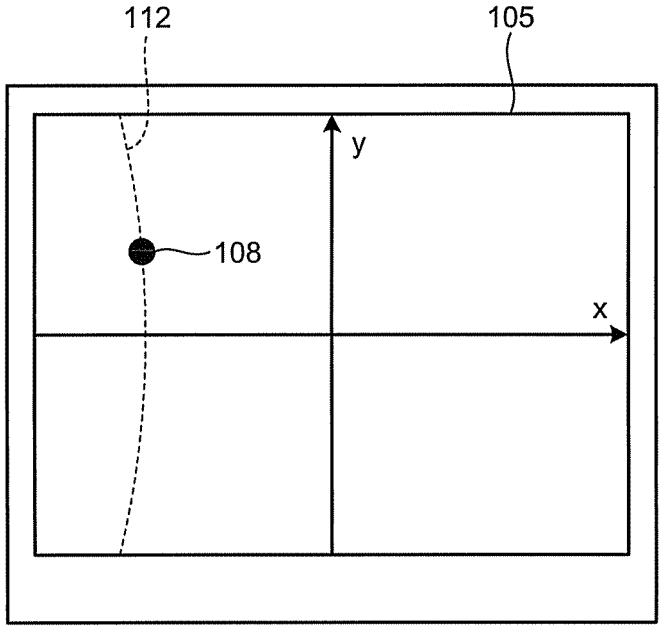
FIGS. 3A and 3B are diagrams showing an acoustic directivity center image on an imaging plane.
Figure 3B:
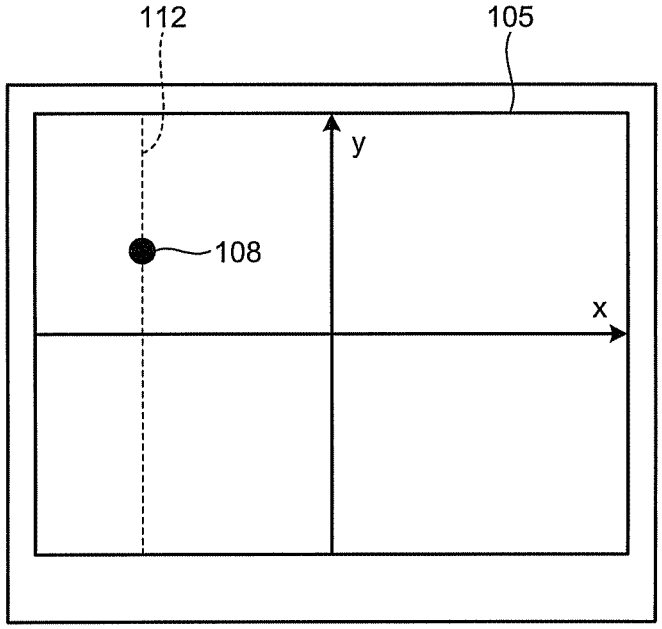

FIGS. 3A and 3B are diagrams showing examples of an acoustic directivity center image 112 on the imaging plane 105. From the foregoing equation (5), the acoustic directivity center image 112 with respect to the subject image 108 traces a quadratic curve such as shown in FIG. 3A. If the imaging range 106 of the imaging system is sufficiently narrow, the quadratic curve of the acoustic directivity center image 112 on the imaging plane 105 can be approximated by a straight line parallel to the y-axis (y=x1) as shown in FIG. 3B because the quadratic curve has a small curvature. Such an approximation is equivalent to $\phi=\phi x$, in which case the arrival time difference T is determined from x1 by using the foregoing equation (1) and equation (3).

First Embodiment

Figure 4:
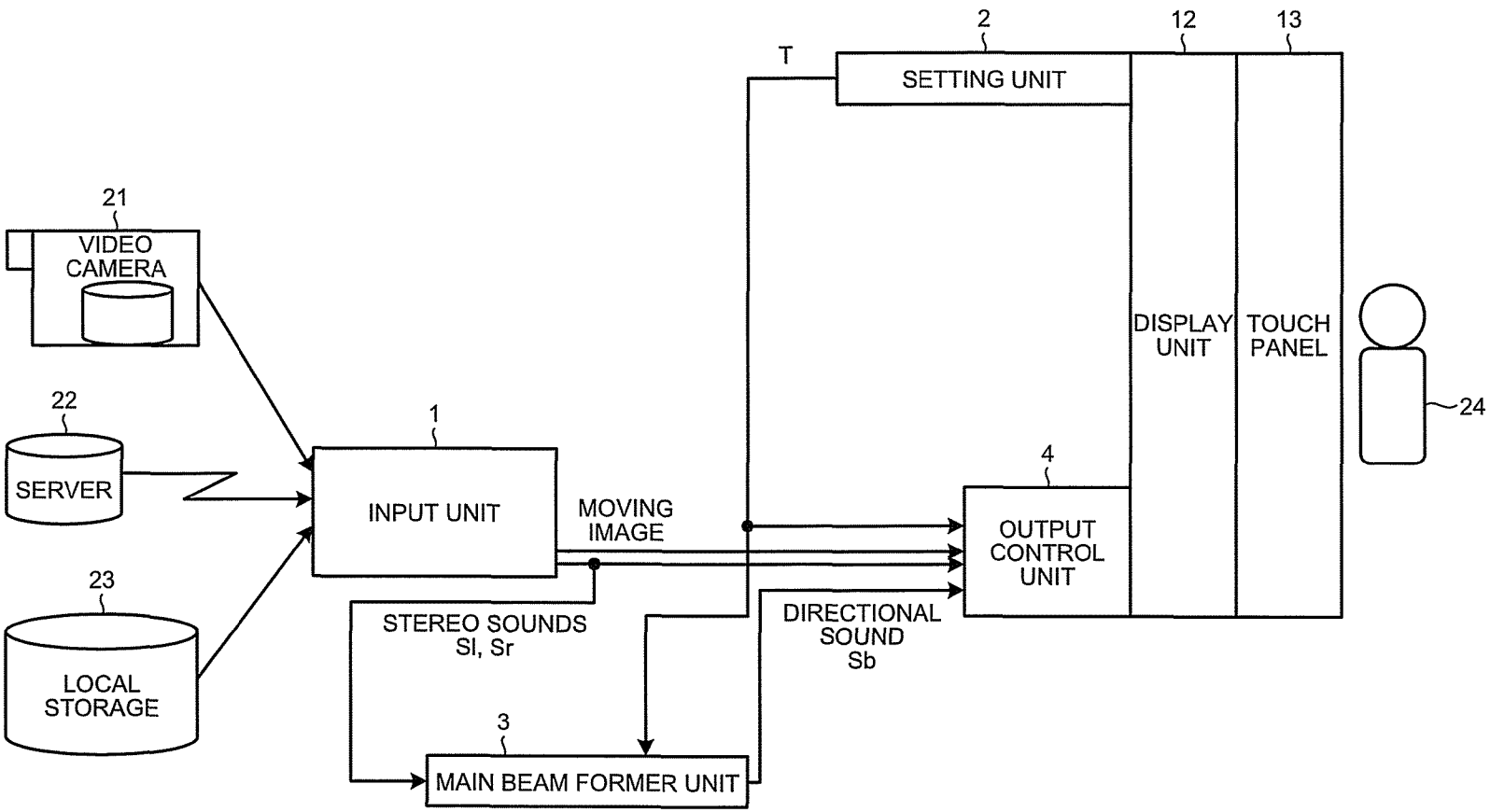
FIG. 4 is a functional block diagram of an apparatus for presenting a moving image with sound according to a first embodiment.

FIG. 4 shows the functional block configuration of an apparatus for presenting a moving image with sound according to a first embodiment which is configured on the basis of the foregoing assumptions. As shown in FIG. 4, the apparatus for presenting a moving image with sound according to the present embodiment includes an input unit 1, a setting unit 2, a main beam former unit 3, and an output control unit 4. The apparatus for presenting a moving image with sound according to the present embodiment is also equipped with a display unit 12 for displaying a moving image and a touch panel 13 for accepting operation inputs made by a user 24.

The input unit 1 inputs data on a moving image with sound, including a plurality of channels of sounds simultaneously recorded by a plurality of microphones and a moving image. For example, the input unit 1 inputs data on a moving image with sound that is shot and recorded by a video camera 21, or data on a moving image with sound that is recorded on a server 22 which is accessible through a communication channel or a local storage 23 which is accessible without a communication channel. Based on a read instruction operation made by the user 24, the input unit 1 performs the operation of inputting data on a predetermined moving image with sound and outputting the data as moving image data and sound data separately. For the sake of simplicity, the following description will be given on the assumption that the sound included in the moving image with sound is two channels of stereo recorded sound that are simultaneously recorded by stereo microphones.

The setting unit 2 sets the arrival time difference T between the L channel sound Sl and R channel sound Sr of the stereo recorded sound included in the moving image with sound, according to an operation that the user 24 makes, for example, from the touch panel 13. The arrival time difference T, more specifically, refers to a difference in time between the L channel sound Sl and the R channel sound Sr of the sound that is in the direction to be enhanced by the main beam former unit 3 described later. The setting of the arrival time difference T by the setting unit 2 corresponds to setting the acoustic directivity center mentioned above. As will be described later, the user 24 listens to a directional sound Sb output by the output control unit 4 and makes the operation for setting the arrival time difference T so that sound coming from a desired subject is enhanced in the directional sound Sb. According to the operation of the user 24, the setting unit 2 updates the setting of the arrival time difference T when needed.

The main beam former unit 3 generates the directional sound Sb, in which the sound in the directions having the arrival time difference T set by the setting unit 2 is enhanced, from the stereo sounds 51 and Sr and outputs the same. The main beam former unit 3 can be implemented by a technique using a delay-sum array for performing an in-phase addition with the arrival time difference T as the amount of delay, or an adaptive array to be described later. Even if the microphone-to-microphone distance d is unknown, the directional sound Sb in which the sound in the directions having the arrival time difference T is enhanced can be generated as long as the arrival time difference T set by the setting unit 2 is equal to the actual arrival time difference. Thus, in the apparatus for presenting a moving image with sound according to the present embodiment, the user 24 makes an operation input for setting the arrival time difference T of the acoustic system instead of inputting the subject position (x1, y1) of the imaging system as with the conventional technology.

The output control unit 4 outputs the directional sound Sb generated by the main beam former unit 3 along with the moving image. More specifically, the output control unit 4 makes the display unit 12 display the moving image on basis of the moving image data output from the input unit 1. In synchronization with the moving image displayed on the display unit 12, the output control unit 4 outputs the directional sound Sb generated by the main beam former unit 3 in the form of sound waves from not-shown loudspeakers or a headphone terminal.

Figure 5:
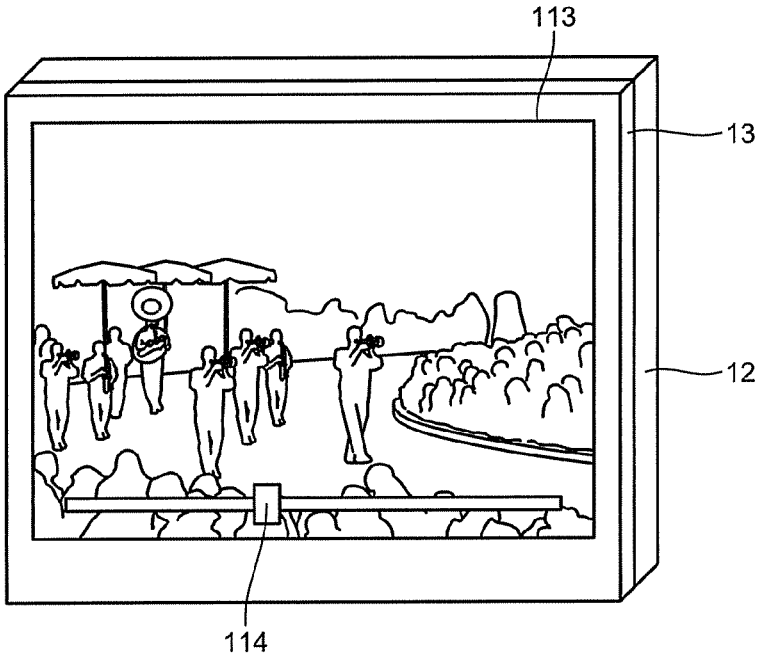
FIG. 5 is a diagram showing an example of a user interface.

FIG. 5 is a diagram showing an example of a user interface which accepts an operation input of the user 24 for setting the arrival time difference T. In the apparatus for presenting a moving image with sound according to the present embodiment, as shown in FIG. 5, an optically transparent touch panel 13 for accepting an operation input of the user 24 is arranged on a display screen 113 of the display unit 12. A slide bar 114 such as shown in FIG. 5 is displayed on the display screen 113 of the display unit 12. The user 24 touches the touch panel 13 to make a sliding operation on the slide bar 114 displayed on the display screen 113. According to the operation on the slide bar 114, the setting unit 2 sets the arrival time difference T.

To cause the slide bar 114 to function as shown in FIG. 5, a range of values of the arrival time difference T is required that can be set by the operation of the slide bar 114. Such a range of arrival time differences T settable will be defined by Tc, where $-Tc \le T \le Tc$. Tc needs to have an appropriate value that can cover the actual T value. For example, the slide bar 114 may be prepared for Tc=0.001 sec. This corresponds to the time it takes for sound waves to move over a distance of 34 cm, given that the velocity of sound Vs is approximated by 340 m/s. That is, the setting is predicated on that the microphone-to-microphone distance d is no greater than 34 cm.

Theoretically, it is appropriate to take Tm in the foregoing equation (4) for Tc. Tm in the foregoing equation (4), however, can be determined only if the microphone-to-microphone distance d is known. Since the correct value of the microphone-to-microphone distance d is unknown, some appropriate value d' will be assumed. This makes it possible to set the arrival time difference T within the range of $-Tm' \le T \le Tm'$, where Tm' is given by equation (6) seen below. That is, Tc=Tm' is assumed. As a result, the directivity angle is expressed as $\phi'$ in equation (7) seen below, whereas there is no guarantee that $\phi'$ is the same as the right coming direction $\phi$ for the same arrival time difference T. The variable range of the arrival time difference T, or $\pm Tm'$, is in proportion to the microphone-to-microphone distance d. The stereo microphones of a typical movie camera have a microphone-to-microphone distance d of the order of 2 to 4 cm. d' is thus set to a greater value to make Tm'>Tm, so that the actual range of values of the arrival time difference T ($\pm$Tm) can be covered.

$$Tm' = d'/Vs \tag{6}$$

$$\phi' = \sin^{-1}(T \cdot Vs/d') \tag{7}$$

With the introduction of such a virtual microphone-to-microphone distance d', the setting unit 2 may set $\alpha = T/Tm'$ given by equation (8) seen below according to the operation of the user 24 instead of setting the arrival time difference T. $\alpha$ can be set within the range of $-1 \le \alpha \le 1$. Note that the range of effective values of a is narrower than $-1 \le \alpha \le 1$ since Tm' is greater than the actual Tm. Alternatively, the setting unit 2 may set the value of the directivity angle $\phi'$ given by equation (9) seen below within the range of $-90° \le \phi \le 90°$ according to the operation of the user 24. Note that the range of effective values of $\phi'$ is narrower than $-90° \le \phi \le 90°$, and there is no guarantee that the direction of that value is the same as the actual direction. In any case, once the virtual microphone-to-microphone distance d' is introduced, the arrival time difference T can be set by setting $\alpha$ or $\phi'$ according to the operation of the user 24, as shown in equation (10) or (11) seen below. In other words, setting $\alpha$ or $\phi'$ according to the operation of the user 24 is equivalent to setting the arrival time difference T. The user 24 can make the foregoing operation on the slide bar 114 to set the arrival time difference T irrespective of the parameters of the imaging system.

$$\alpha = T/Tm' = T \cdot Vs/d' \tag{8}$$

$$\phi' = \sin^{-1}(\alpha) \tag{9}$$

$$T = \alpha \cdot Tm' = \alpha \cdot d'/Vs \tag{10}$$

$$T = d' \cdot \sin(\phi')/Vs \tag{11}$$

The slide bar 114 shown in FIG. 5 is only a specific example of the method for accepting the operation of the user 24 for setting the arrival time difference T. The method of accepting the operation of the user 24 is not limited to this example, and various methods may be used. For example, a user interface from which the user 24 directly inputs a numerical value may be provided. The setting unit 2 may set the arrival time difference T according to the numerical value input by the user 24. The apparatus for presenting a moving image with sound according to the present embodiment is configured such that the user 24 can select from a not-shown user interface a moving image with sound for the apparatus to read, and make an operation to give an instruction for a reproduction (play) start, reproduction (play) stop, fast forward, and rewind of the selected moving image with sound, and for cueing and the like to a desired time of the moving image with sound.

Figure 6:
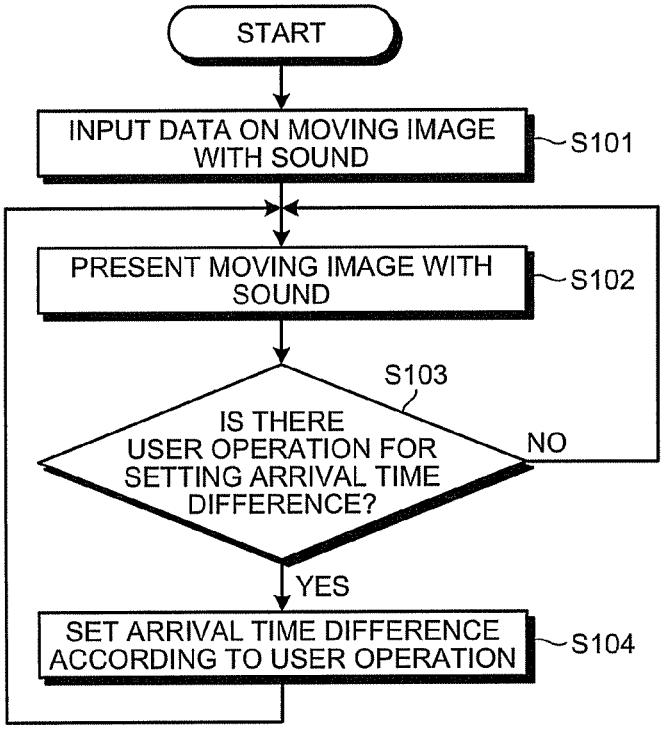
FIG. 6 is a flowchart showing the procedure of processing to be performed by the apparatus for presenting a moving image with sound according to the first embodiment.

FIG. 6 is a flowchart showing the procedure of basic processing of the apparatus for presenting a moving image with sound according to the present embodiment. The series of processing shown in the flowchart of FIG. 6 is started, for example, when the user 24 makes an operation input to give an instruction to read a moving image with sound. The processing continues until the user 24 stops, fast-forwards, rewinds, or makes a cue or the like to the data on the moving image with sound under reproduction or until the data on the moving image with sound reaches its end.

When the user 24 makes an operation input to give an instruction to read a moving image with sound, the input unit 1 initially inputs the data on the specified moving image with sound, and outputs the input data on the moving image with sound as moving image data and sound data (stereo sounds Sl and Sr) separately (step S101). At the point in time when the processing of reading the moving image with sound is completed (before the user 24 makes an operation to set the arrival time difference T), the arrival time difference T is set to an appropriate initial value such as 0 (0° in front in terms of the acoustic directivity of the main beam former unit 3).

The moving image with sound that is read (moving image data and sound data) can be handled as time series data that contains consecutive data blocks sectioned in each unit time interval. In the next step S102 and subsequent steps, the data blocks are fetched in succession in time series order for loop processing. More specifically, the input unit 1 reads the moving image with sound into the apparatus. After input operations for the foregoing rewinding, fast-forwarding, cueing, etc., the user 24 makes an operation input to give an instruction to start reproducing the moving image with sound at a desired time. The blocks of the moving image data and sound data (stereo sounds Sl and Sr) from the input unit 1 are then fetched and processed in succession from the specified time in time series order. While the data blocks are being fetched and processed in succession in time series order, the data can be regarded as continuous data. In the following processing, the term "data block" will thus be omitted.

The main beam former unit 3 inputs the fetched sound data (stereo sounds Sl and Sr), and generates and outputs data on a directional sound Sb in which the sound in the directions having the currently-set arrival time difference T (an initial value of 0 as mentioned above) is enhanced. The output control unit 4 fetches data that is concurrent with the sound data (stereo sounds Sl and Sr) from the moving image data output by the input unit 1, and makes the display unit 12 display the moving image. The output control unit 4 also outputs the data on the directional sound Sb given by the main beam former unit 3 as sound waves through the loudspeakers or headphone terminal, thereby presenting the moving image with sound to the user 24 (step S102). Here, if the main beam former unit 3 causes any delay, the output control unit 4 outputs the directional sound Sb and the moving image in synchronization so as to compensate the delay, and presents the resultant to the user 24. Aside from the moving image, the slide bar 114 such as shown in FIG. 5 is displayed on the display screen 113 of the display unit 12.

While the presentation of the moving image with sound at step S102 continues, a determination is regularly made as to whether or not an operation for setting the arrival time difference T is made by the user 24 who watches and listens to the moving image with sound (step S103). For example, it is determined whether or not a touching operation on the touch panel 13 is made to slide the slide bar 114 shown in FIG. 5. If no operation is made by the user 24 to set the arrival time difference T (step S103: No), the processing simply returns to step S102 to continue the presentation of the moving image with sound. On the other hand, if the operation for setting the arrival time difference T is made by the user 24 (step S103: Yes), the setting unit 2 sets the arrival time difference T between the stereo sounds Sl and Sr included in the moving image with sound according to the operation of the user 24 (step S104).

The setting unit 2 performs the processing of step S104 each time the operation for setting the arrival time difference T (for example, the operation to slide the slide bar 114 shown in FIG. 5) is made by the user 24 who watches and listens to the moving image with sound. At step S102, the main beam former unit 3 generates a directional sound Sb based on the new setting of the arrival time difference T when needed, and the output control unit 4 presents the directional sound Sb to the user 24 along with the moving image. To put it another way, the user 24 watches and listens to the presented moving image with sound and freely accesses desired positions by the above-mentioned operations such as a play, stop, pause, fast forward, rewind, and cue. When, for example, the user 24 slides the slide bar 114 so that a desired sound is enhanced, the setting unit 2 sets the arrival time difference T and the main beam former unit 3 generates a new directional sound Sb when needed according to the operation of the user 24.

As described above, according to the apparatus for presenting a moving image with sound of the present embodiment, when the user 24 who is watching the moving image displayed on the display unit 12 makes an operation of, for example, sliding the slide bar 114, the arrival time difference T intended by the user 24 is set by the setting unit 2. A directional sound Sb in which the sound in the directions of the set arrival time difference T is enhanced is generated by the main beam former unit 3. The directional sound Sb is output with the moving image by the output control unit 4, and thereby presented to the user 24. This allows the user 24 to acoustically find out the directional sound Sb in which the sound from a desired subject is enhanced, i.e., the proper value of the arrival time difference T by adjusting the arrival time difference T while listening to the directional sound Sb presented. As described above, such an operation can be made even if the correct microphone-to-microphone distance d is unknown. According to the apparatus for presenting a moving image with sound of the present embodiment, it is therefore possible to enhance and output the sound issued from a desired subject even in a moving image with sound where the focal length f of the imaging device at the time of shooting and the microphone-to-microphone distance d are unknown.

The range of directivity angles available in the conventional technology has been limited to the imaging range 106. In contrast, according to the apparatus for presenting a moving image with sound of the present embodiment where the arrival time difference T is set on the basis of the operation of the user 24, the user 24 can enhance and listen to a sound that comes from even outside of the imaging range 106 when the imaging range 106 is narrower than ±90°.

Second Embodiment

Next, an apparatus for presenting a moving image with sound according to a second embodiment will be described. The apparatus for presenting a moving image with sound according to the present embodiment has the function of calculating a calibration parameter. The calibration parameter defines the relationship between the position coordinates of an object specified by the user 24, which is the source of enhanced sound in the moving image that is output with a directional sound Sb, and the arrival time difference T set by the setting unit 2.

Figure 7:
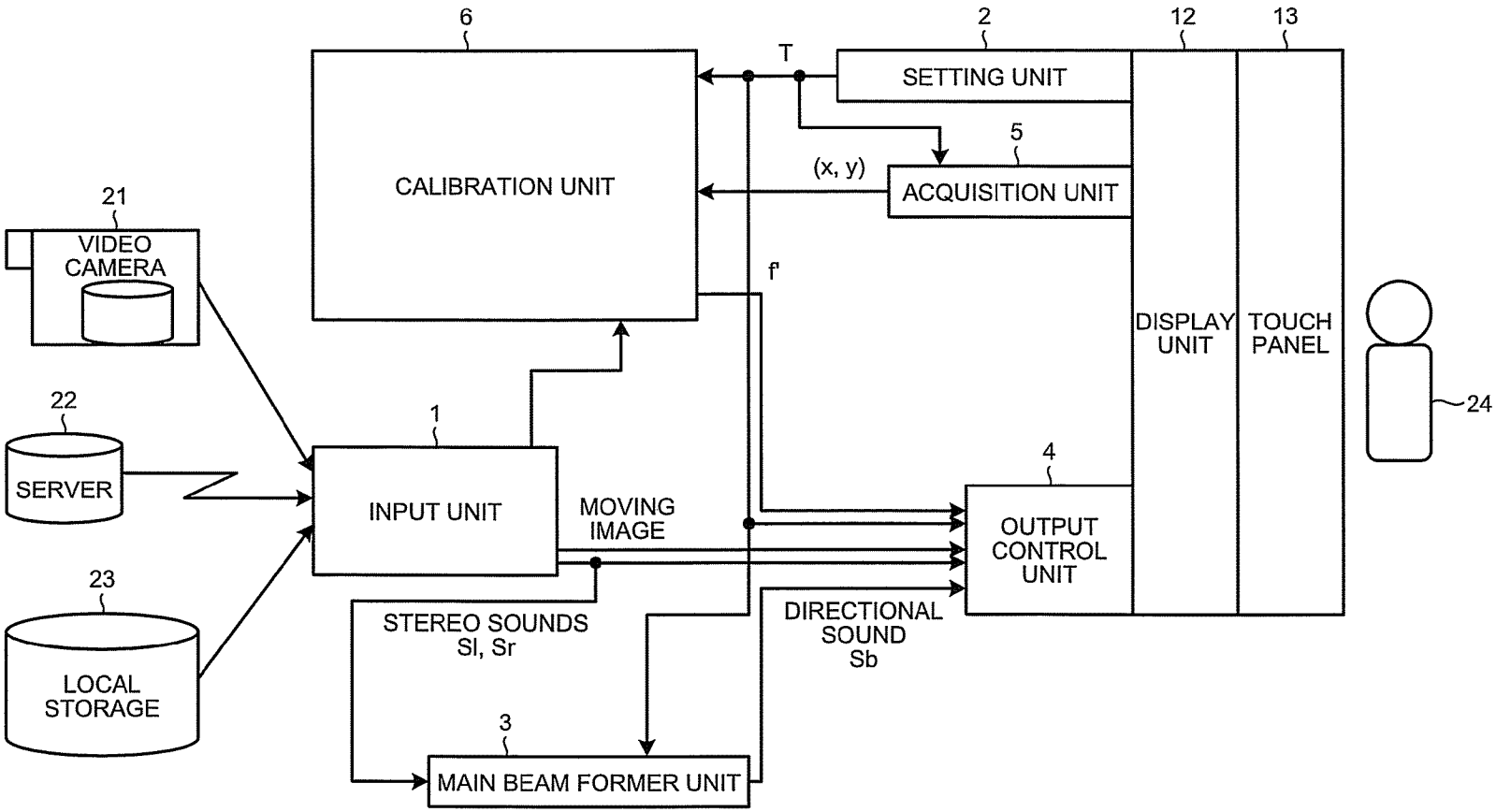
FIG. 7 is a functional block diagram of an apparatus for presenting a moving image with sound according to a second embodiment.

FIG. 7 shows the functional block configuration of the apparatus for presenting a moving image with sound according to the present embodiment. The apparatus for presenting a moving image with sound according to the present embodiment includes an acquisition unit 5 and a calibration unit 6 which are added to the configuration of the apparatus for presenting a moving image with sound according to the foregoing first embodiment. In other respects, the configuration is the same as in the first embodiment. Hereinafter, the same components as those of the first embodiment will thus be designated by like reference numerals, and a redundant description will be omitted. The following description will deal with the characteristic configuration of the present embodiment.

Figure 8:
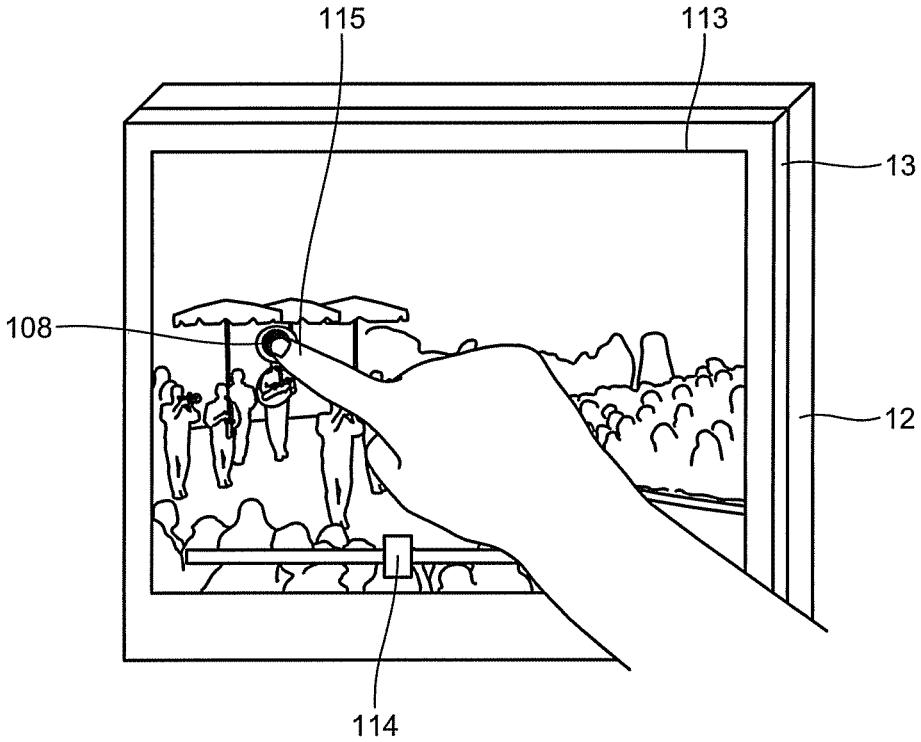
FIG. 8 is a diagram showing a user specifying an object to which an acoustic directivity center is directed.

The acquisition unit 5 acquires the position coordinates of an object that the user 24 recognizes as the source of enhanced sound in the moving image currently displayed on the display unit 12. Namely, the acquisition unit 5 acquires the position coordinates of a subject to which the acoustic directivity center is directed in the moving image when the user 24 specifies the subject in the moving image. A specific description will be given in conjunction with an example shown in FIG. 8. Suppose that the user 24 touches the position of a subject image 108, to which the acoustic directivity center is directed, with a finger tip 115 or the like (or click the position with a mouse which is also made available) when the moving image is displayed on the display screen 113 of the display unit 12. The acquisition unit 5 reads the coordinate values (x1, y1) of the position touched (or clicked) by the user 24 from the touch panel 13, and transmits the coordinate values to the calibration unit 6.

The calibration unit 6 calculates a calibration parameter (virtual focal length f') which defines the numerical relationship between the coordinate values (x1, y1) acquired by the acquisition unit 5 and the arrival time difference T set by the setting unit 2. Specifically, the calibration unit 6 determines f' that satisfies equation (12) seen below, on the basis of the approximation that ϕ' in the foregoing equation (7) which contains the arrival time difference T is equal to ϕx in the foregoing equation (1) which contains x1. Alternatively, without such an approximation, f' for the case where the acoustic directivity center image with a directivity angle of ϕ' passes the point (x1, y1) may be determined as the square root of the right-hand side of equation (13) seen below which is derived from the foregoing equation (5).

$$f'=x1/\tan(\phi x)=x1/\tan(\sin^{-1}(T\cdot Vs/d')) \tag{12}$$

$$f'^2 = x1^2(\tan^2(\phi') - y1^2 = x1^2\cdot\tan^2(\sin^{-1}(T\cdot Vs/d')) - y1^2 \tag{13}$$

There is no guarantee that the virtual focal length f' determined here has the same value as that of the actual focal length f. The virtual focal length f', however, provides a geometrical numerical relationship between the imaging system and the acoustic system under the virtual microphone-to-microphone distance d'. When the calibration using the foregoing equation (12) or equation (13) is performed, the values of x1 and y1 and the value of the arrival time difference T at the time of performing calibration are recorded. The thus recorded values of x1, y1 and T are used when modifying the virtual microphone-to-microphone distance d' as will be described later.

Figure 9A:
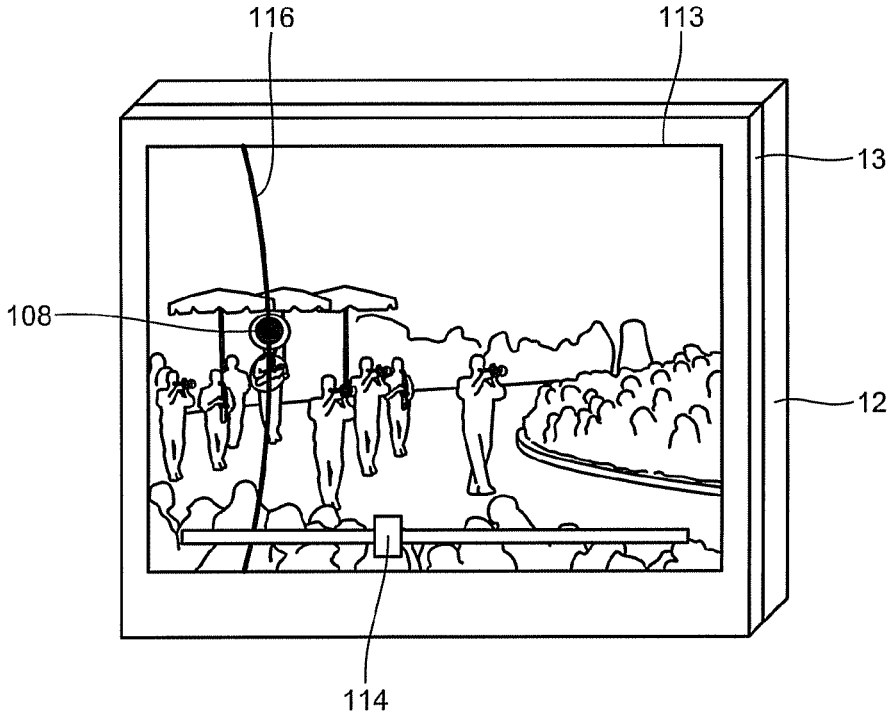
FIGS. 9A and 9B are diagrams showing an acoustic directivity center mark displayed as superimposed on the moving image.
Figure 9B:
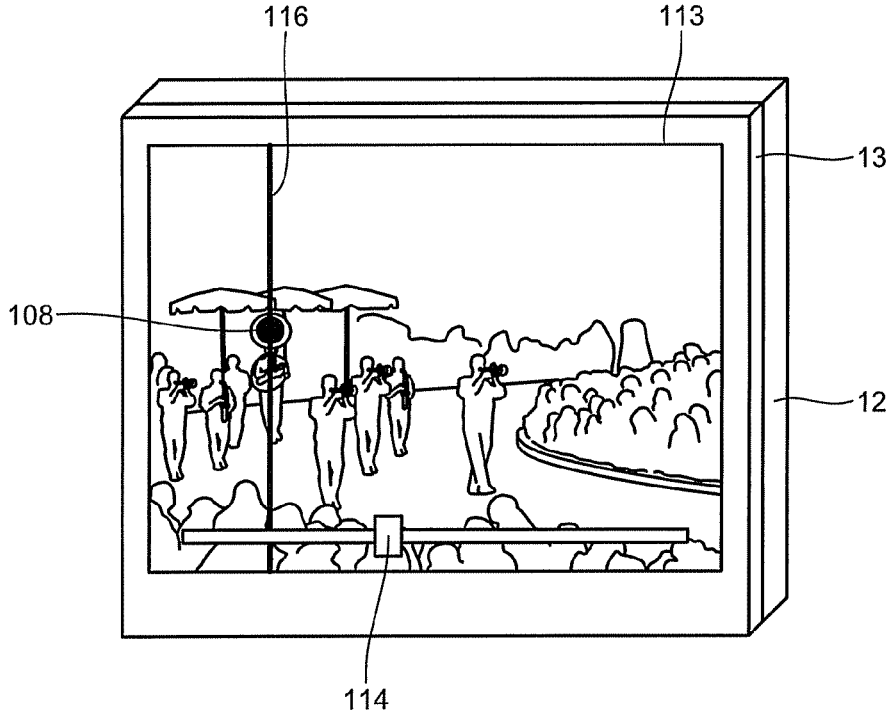

Once the virtual focal length f' for the virtual microphone-to-microphone distance d' is determined by the foregoing calibration, in which f' being consistent with d', the output control unit 4 substitutes f' for f in the foregoing equation (5). This allows the calculation of the acoustic directivity center image within $0°<|\phi'|<90°$. The output control unit 4 then determines whether the acoustic directivity center image calculated falls inside or outside the moving image that is currently displayed. If the acoustic directivity center image falls inside the currently-displayed moving image, as exemplified in FIGS. 9A and 9B, an acoustic directivity center mark 116 (mark that indicates the range of directions of the sound for the main beam former unit 3 to enhance) is displayed in the corresponding position of the display screen 113 as superimposed on the moving image. This provides feedback to the user 24 as to where the current acoustic directivity center is. Now, when the user 24 moves the slide bar 114 to change the arrival time difference T, the output control unit 4 displays an acoustic directivity center mark 116 corresponding to the new arrival time difference T in position if the acoustic directivity center calculated from the new arrival time difference T and the virtual focal length f' falls inside the currently-displayed moving image. The acoustic directivity center mark 116 is preferably displayed semi-transparent so that the corresponding portions of the moving image show through, without the acoustic directivity center mark 116 interfering with the visibility of the moving image.

After the virtual focal length f' is determined by the foregoing calibration, the user 24 may specify an object (subject) in the moving image, to which the acoustic directivity center is to be directed, by the operation similar to the operation for specifying the object (subject) for the calibration to which the acoustic directivity center is directed. That is, once the virtual focal length f' is determined by the calibration, a directional sound Sb in which the sound from a specified object is enhanced can generated by specifying the object to enhance the sound of in the image (i.e., by the operation of inputting the arrival time difference T) similarly to the conventional technology.

The apparatus for presenting a moving image with sound according to the present embodiment is configured such that the operation of specifying an object intended for calibration for determining the foregoing virtual focal length f' and the operation of specifying an object to which the acoustic directivity center is to be directed can be switched by an operation of the user 24 on the touch panel 13. Specifically, the two operations are distinguished, for example, as follows. To specify an object for calibration (i.e., for the operation of calculating the virtual focal length f'), the user 24 presses and holds the display position of the object (subject) in the moving image on the touch panel 13. To specify an object to which the acoustic directivity center is to be directed (i.e., for the operation of inputting the arrival time difference T), the user 24 briefly touches the display position of the object on the touch panel 13. Alternatively, the distinction between the two operations may be made by double tapping to specify an object for calibration and by single tapping to specify an object to which the acoustic directivity center is to be directed. Otherwise, a select switch may be displayed near the foregoing slide bar 114 so that the user 24 can operate the select switch to switch between the operation for specifying an object for calibration and the operation for specifying an object to which the acoustic directivity center is to be directed. In any case, after the operation of specifying an object for calibration is performed to determine the virtual focal length f', it is made possible for the user 24 to perform the operation of specifying an object to which the acoustic directivity center is to be directed by the same operation.

Figure 10:
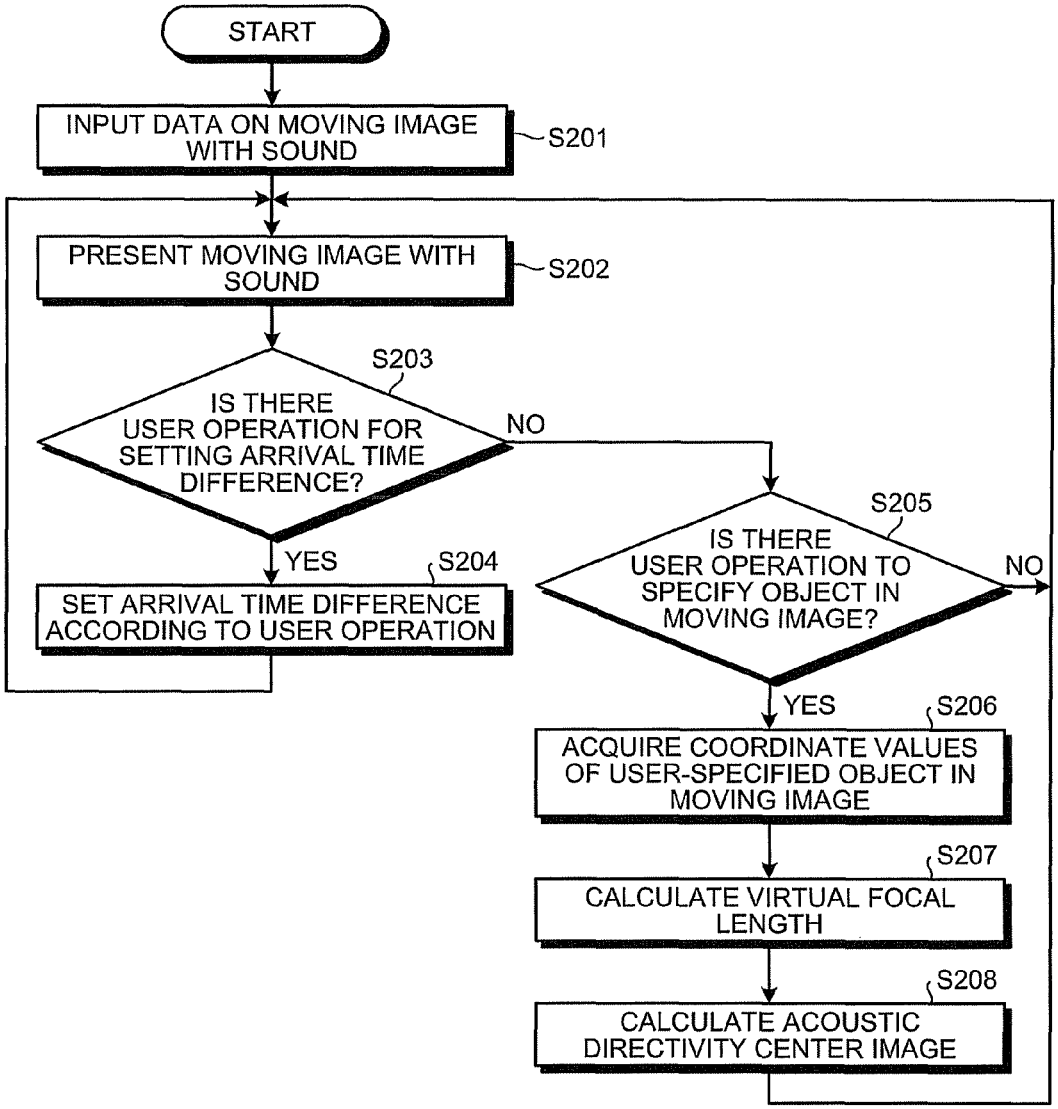
FIG. 10 is a flowchart showing the procedure of processing to be performed by the apparatus for presenting a moving image with sound according to the second embodiment.

FIG. 10 is a flowchart showing the procedure of basic processing of the apparatus for presenting a moving image with sound according to the present embodiment. Like the processing shown in the flowchart of FIG. 6, the series of processing shown in the flowchart of FIG. 10 is started, for example, when the user 24 makes an operation input to give an instruction to read a moving image with sound. The processing continues until the user 24 stops, fast-forwards, rewinds, or makes a cue or the like to the data on the moving image with sound under reproduction or until the data on the moving image with sound reaches its end. Since the processing of steps S201 to S204 in FIG. 10 is the same as that of steps S101 to S104 in FIG. 6, a description thereof will be omitted.

Suppose that the arrival time difference T is set according to the operation of the user 24, and a directional sound Sb in which the sound in the directions of the arrival time difference T is enhanced is presented to the user 24 along with the moving image. In the present embodiment, a determination is regularly made not only as to whether or not the operation for setting the arrival time difference T is made, but also as to whether or not the operation of specifying in the moving image an object that is recognized as the source of the enhanced sound is made by the user 24. That is, it is also regularly determined whether or not the operation of specifying an object intended for calibration for determining the virtual focal length f' is made by the user 24 (step S205). If no operation is made by the user 24 to specify an object that is recognized as the source of the enhanced sound (step S205: No), the processing simply returns to step S202 to continue the presentation of the moving image with sound. On the other hand, if the operation of specifying an object that is recognized as the source of the enhanced sound is made by the user 24 (step S205: Yes), the acquisition unit 5 acquires the coordinate values (x1, y1) of the object specified by the user 24 in the moving image (step S206).

More specifically, the user 24 listens to the directional sound Sb and adjusts the arrival time difference T to acoustically find out the directional sound Sb, in which the sound coming from a desired subject is enhanced, and the value of the arrival time difference T. The user 24 then specifies where the sound-issuing subject is in the moving image displayed on the display unit 12. After such an operation of the user 24, the acquisition unit 5 acquires the coordinate values (x1, y1) of the object (subject) specified by the user 24 in the moving image.

Next, using x1 and y1 acquired by the acquisition unit 5, the calibration unit 6 calculates the virtual focal length f' corresponding to the arrival time difference T set by the setting unit 2 by the foregoing equation (12) or equation (13) (step S207). As a result, the numerical relationship between the arrival time difference T and the coordinate values (x1, y1) becomes clear.

Next, using the virtual focal point f' calculated in step S207, the output control unit 4 calculates the acoustic directivity center image which indicates the range of coming directions of the sound having the arrival time difference T set by the setting unit 2 (step S208). The processing then returns to step S202 to output the directional sound Sb generated by the main beam former unit 3 along with the moving image for the sake of presentation to the user 24. If the acoustic directivity center image determined in step S208 falls inside the currently-displayed moving image, an acoustic directivity center mark 116 (mark that indicates the range of directions of the sound for the main beam former unit 3 to enhance) is displayed in the corresponding position of the display screen 113 as superimposed on the moving image. This provides feedback to the user 24 as to where the current acoustic directivity center is on the moving image.

As has been described above, according to the apparatus for presenting a moving image with sound of the present embodiment, when a moving image with sound is presented to the user 24, the user 24 makes an operation to specify an object that the user 24 recognizes as the source of the enhanced sound, i.e., a subject to which the acoustic directivity center is directed. Then, a virtual focal length f' for and consistent with a virtual microphone-to-microphone distance d' is determined. The virtual focal length f' is used to calculate the acoustic directivity center image, and the acoustic directivity center mark 116 is displayed as superimposed on the moving image. This makes it possible for the user 24 to recognize where the acoustic directivity center is in the moving image that is displayed on the display unit 12.

Since the virtual focal length f' is determined by calibration, the numerical relationship between the arrival time difference T and the coordinate values (x1, y1) is clarified. Subsequently, the user 24 can perform the operation of specifying an object in the moving image displayed on the display unit 12, whereby a directional sound Sb in which the sound from the object specified by the user 24 is enhanced is generated and presented to the user 24.

Third Embodiment

Next, an apparatus for presenting a moving image with sound according to a third embodiment will be described. The apparatus for presenting a moving image with sound according to the present embodiment has the function of keeping track of an object (subject) that is specified by the user 24 and to which the acoustic directivity center is directed in the moving image. The function also includes modifying the arrival time difference T by using the virtual focal length f' (calibration parameter) so that the acoustic directivity center continues being directed to the object specified by the user 24.

Figure 11:
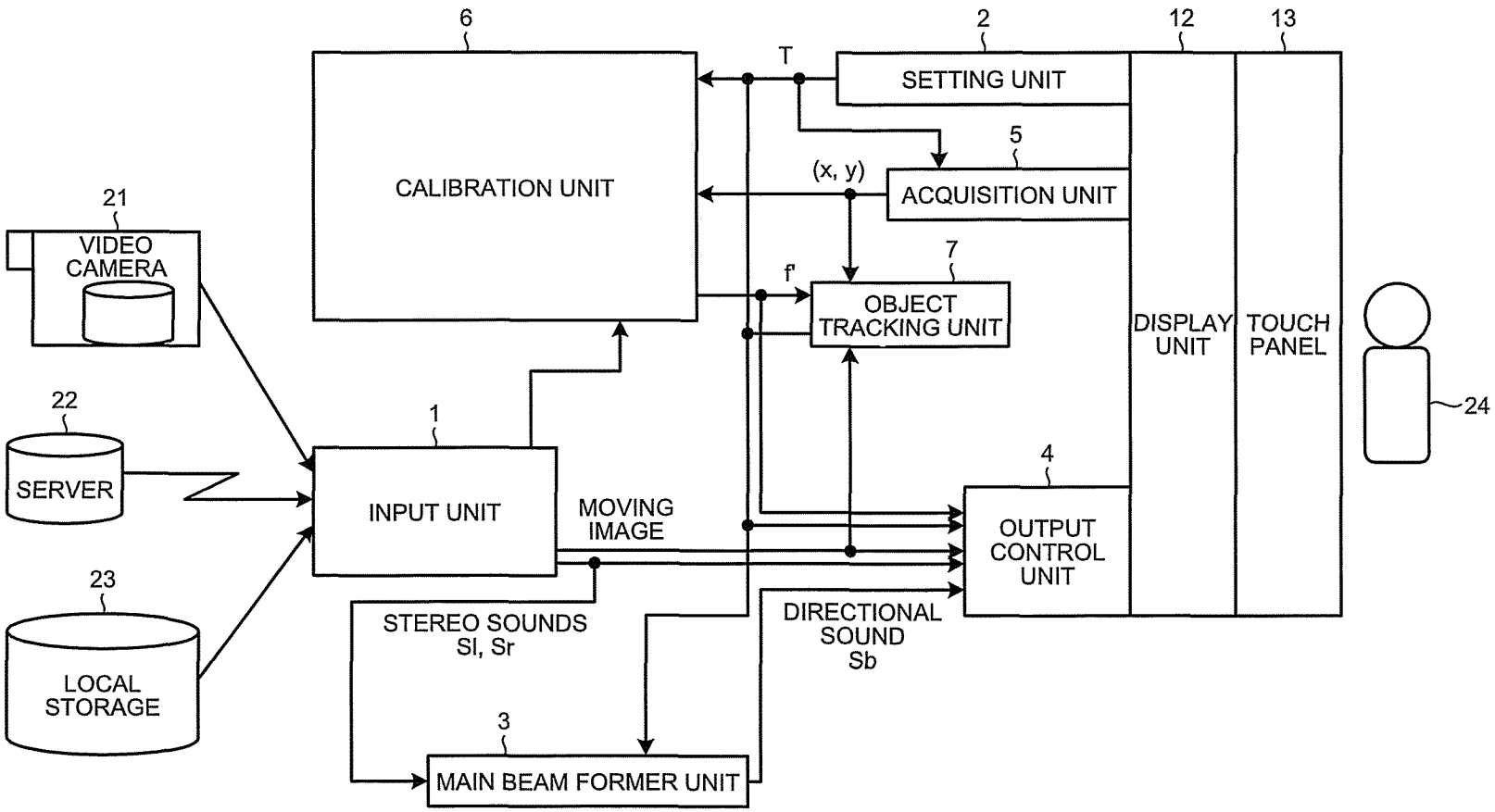
FIG. 11 is a functional block diagram of an apparatus for presenting a moving image with sound according to a third embodiment.

FIG. 11 shows the functional block configuration of the apparatus for presenting a moving image with sound according to the present embodiment. The apparatus for presenting a moving image with sound according to the present embodiment includes an object tracking unit 7 which is added to the configuration of the apparatus for presenting a moving image with sound according to the foregoing second embodiment. In other respects, the configuration is the same as in the first and second embodiments. Hereinafter, the same components as those of the first and second embodiments will thus be designated by like reference numerals, and a redundant description will be omitted. The following description will deal with the characteristic configuration of the present embodiment.

The object tracking unit 7 generates and stores an image feature of the object specified by the user 24 (for example, the subject image 108 shown in FIGS. 9A and 9B) in the moving image. Based on the stored feature, the object tracking unit 7 keeps track of the object specified by the user 24 in the moving image, updates the coordinate values (x1, y1), and performs control by using the above-mentioned calibration parameter (virtual focal length f') so that the acoustic directivity center of the main beam former unit 3 continues being directed to the object. For example, a particle filter can be used to keep track of the object in the moving image. Since the object tracking using a particle filter is a publicly known technology, a detailed description will be omitted here.

Figure 12:
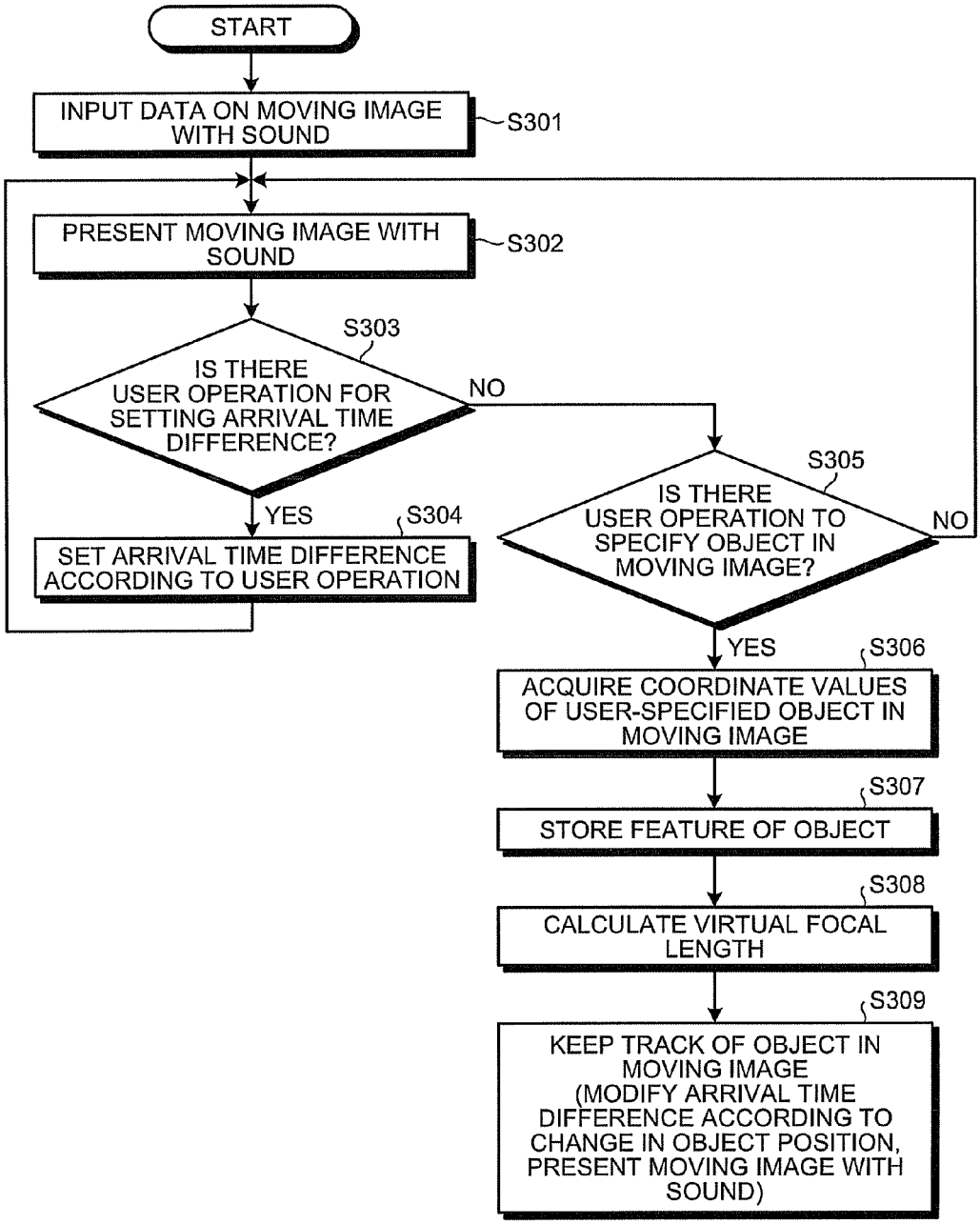
FIG. 12 is a flowchart showing the procedure of processing to be performed by the apparatus for presenting a moving image with sound according to the third embodiment.

FIG. 12 is a flowchart showing the procedure of basic processing of the apparatus for presenting a moving image with sound according to the present embodiment. Like the processing shown in the flowchart of FIG. 10, the series of processing shown in the flowchart of FIG. 12 is started, for example, when the user 24 makes an operation input to give an instruction to read a moving image with sound. The processing continues until the user 24 stops, fast-forwards, rewinds, or makes a cue or the like to the data on the moving image with sound under reproduction or until the data on the moving image with sound reaches its end. Since the processing of steps S301 to S306 in FIG. 12 is the same as that of steps S201 to S206 in FIG. 10, a description thereof will be omitted.

In the present embodiment, when the acquisition unit 5 acquires the coordinate values (x1, y1) of the object (subject image 108) specified by the user 24 in the moving image, the object tracking unit 7 generates and stores an image feature of the object (step S307). Using x1 and y1 acquired by the acquisition unit 5, the calibration unit 6 calculates the virtual focal length f' corresponding to the arrival time difference T set by the setting unit 2 by the foregoing equation (12) or equation (13) (step S308).

Subsequently, when the moving image displayed on the display unit 12 changes, the object tracking unit 7 detects and keeps track of the object (subject image 108) in the moving image displayed on the display unit 12 by means of image processing on the basis of the feature stored in step S307. If the position of the object changes in the moving image, the object tracking unit 7 updates the coordinate values (x1, y1) and regularly modifies the arrival time difference T by using the virtual focal length f' calculated at step S308 so that the acoustic directivity center of the main beam former unit 3 continues being directed to the object (step S309). As a result, a directional sound Sb based on the modified arrival time difference T is regularly generated by the main beam former unit 3, and presented to the user 24 along with the moving image.

As has been described above, the apparatus for presenting a moving image with sound according to the present embodiment is configured such that the object tracking unit 7 keeps track of an object specified by the user 24 in the moving image displayed on the display unit 12, and modifies the arrival time difference T by using the virtual focal length f' (calibration parameter) so that the acoustic directivity center continues being directed to the object specified by the user 24. Even if the position of the object changes in the moving image, it is therefore possible to continue presenting a directional sound Sb in which the sound from the object is enhanced to the user 24.

Fourth Embodiment

Next, an apparatus for presenting a moving image with sound according to a fourth embodiment will be described. The apparatus for presenting a moving image with sound according to the present embodiment has the function of acoustically detecting and dealing with a change in zooming when shooting a moving image with sound.

Figure 13:
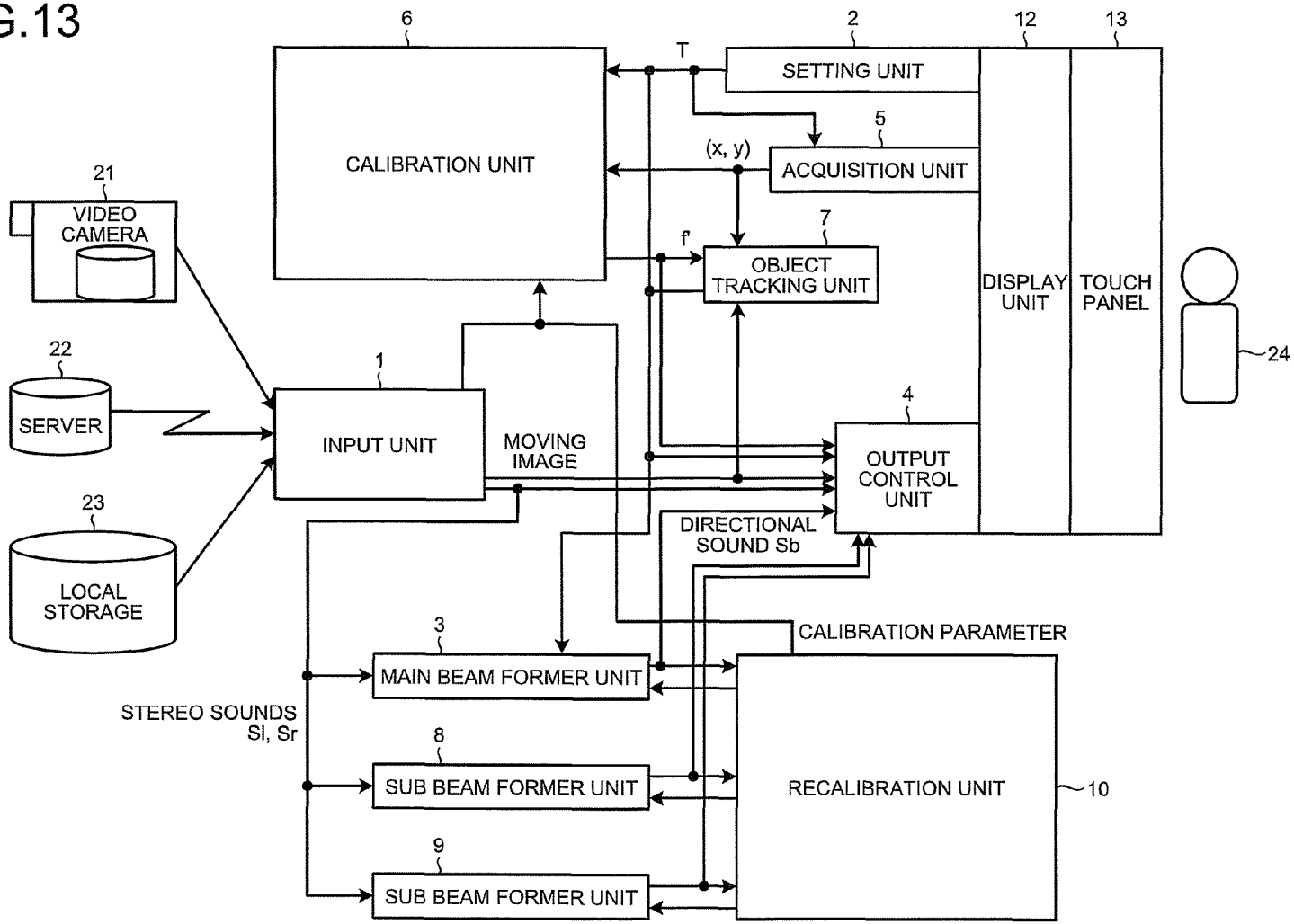
FIG. 13 is a functional block diagram of an apparatus for presenting a moving image with sound according to a fourth embodiment.

FIG. 13 shows the functional block configuration of the apparatus for presenting a moving image with sound according to the present embodiment. The apparatus for presenting a moving image with sound according to the present embodiment includes sub beam former units 8 and 9 and a recalibration unit 10 which are added to the configuration of the apparatus for presenting a moving image with sound according to the foregoing third embodiment. In other respects, the configuration is the same as in the first to third embodiments. Hereinafter, the same components as those of the first to third embodiments will thus be designated by like reference numerals, and a redundant description will be omitted. The following description will deal with the characteristic configuration of the present embodiment.

By means of the object tracking and acoustic directivity control of the object tracking unit 7 which has been described in the third embodiment, the apparatus for presenting a moving image with sound according to the present embodiment can automatically continue directing the acoustic directivity center to an object specified by the user 24 even when the object specified by the user 24 or the imaging apparatus used for shooting moves. This, however, is limited to only when the actual focal length f is unchanged. When the zooming changes to change the focal length f during shooting, a mismatch (inconsistency) occurs between the foregoing virtual focal length f' and the virtual microphone-to-microphone distance d'. The resulting effect appears as a phenomenon that the acoustic directivity that is directed to the object specified by the user 24 on the basis of the virtual focal length f' is always off the right direction. In view of this, the apparatus for presenting a moving image with sound according to the present embodiment is provided with the two sub beam former units 8 and 9 and the recalibration unit 10. The purpose of the provision is that a deviation in acoustic directivity that remains even after the subject tacking and acoustic directivity control of the object tracking unit 7, i.e., a change in zooming during shooting can be acoustically detected and dealt with.

The sub beam former units 8 and 9 have respective acoustic directivity centers that are off the acoustic directivity center of the main bean former unit 3, i.e., the arrival time difference T by a predetermined positive amount ΔT in each direction. Specifically, given that the main beam former unit 3 has an acoustic directivity center with an arrival time difference of T, the sub beam former unit 8 has an acoustic directivity center with an arrival time difference of T−ΔT, and the sub beam former unit 9 an acoustic directivity center with an arrival time difference of T+ΔT. The stereo sounds Sl and Sr from the input unit 1 are input to each of the total of three beam former units, i.e., the main beam former unit 3 and the sub beam former units 8 and 9. The main beam former unit 3 outputs the directional sound Sb corresponding to the arrival time difference T. The sub beam former units 8 and 9 each output a directional sound in which the sound in the directions off those of the sound enhanced by the main beam former unit 3 by the predetermined amount ΔT is enhanced. Now, if the zooming of the imaging apparatus changes to change the focal length f, the acoustic directivity center of the main beam former unit 3 comes off the object specified by the user 24. It follows that the acoustic directivity center of either one of the sub beam former units 8 and 9, which have the acoustic directivity centers on both sides of that of the main beam former unit 3, becomes closer to the object specified by the user 24. The apparatus for presenting a moving image with sound according to the present embodiment detects such a state by comparing the main beam former unit 3 and the sub beam former units 8 and 9 in output power. The values of the output power of the beam former units 3, 8, and 9 to be compared here are averages of the output power of the directional sounds that are generated by the respective beam former units 3, 8, are 9 in an immediate predetermined period (short time).

The recalibration unit 10 calculates and compares the output power of the total of three beam former units 3, 8, and 9. If the output power of either one of the sub beam former units 8 and 9 is detected to be higher than that of the main beam former unit 3, the recalibration unit 10 makes the acoustic directivity center of the main beam former unit 3 the same as that of the sub beam former unit of the highest power. The recalibration unit 10 also re-sets the acoustic directivity centers of the two sub beam former units 8 and 9 off the new acoustic directivity center of the main beam former unit 3 by ΔT in respective directions. Using the coordinate values (x1, y1) of the object under tracking and the newly-set acoustic directivity center (arrival time difference T) of the main beam former unit 3, the recalibration unit 10 recalculates the calibration parameter (virtual focal length f') by the foregoing equation (12) or equation (13). When the recalibration is performed, the values of x1 and y1 and the value of the arrival time difference T at the time of performing recalibration are recorded. The thus recorded values x1, y1 and T are used when modifying the virtual microphone-to-microphone distance d' as will be described later When calculating and comparing the output power of the main beam former unit 3 and the sub beam former units 8 and 9, it is preferable that the recalibration unit 10 calculates and compares the output power of only primary frequency components included in the directional sound Sb that was output by the main beam former unit 3 immediately before (i.e., when the object tracking and acoustic directivity control of the object tracking unit 7 was functioning properly). This can effectively suppress false detection when the output power of the sub beam former unit 8 or 9 becomes higher than that of the main beam former unit 3 due to sudden noise.

Figure 14:
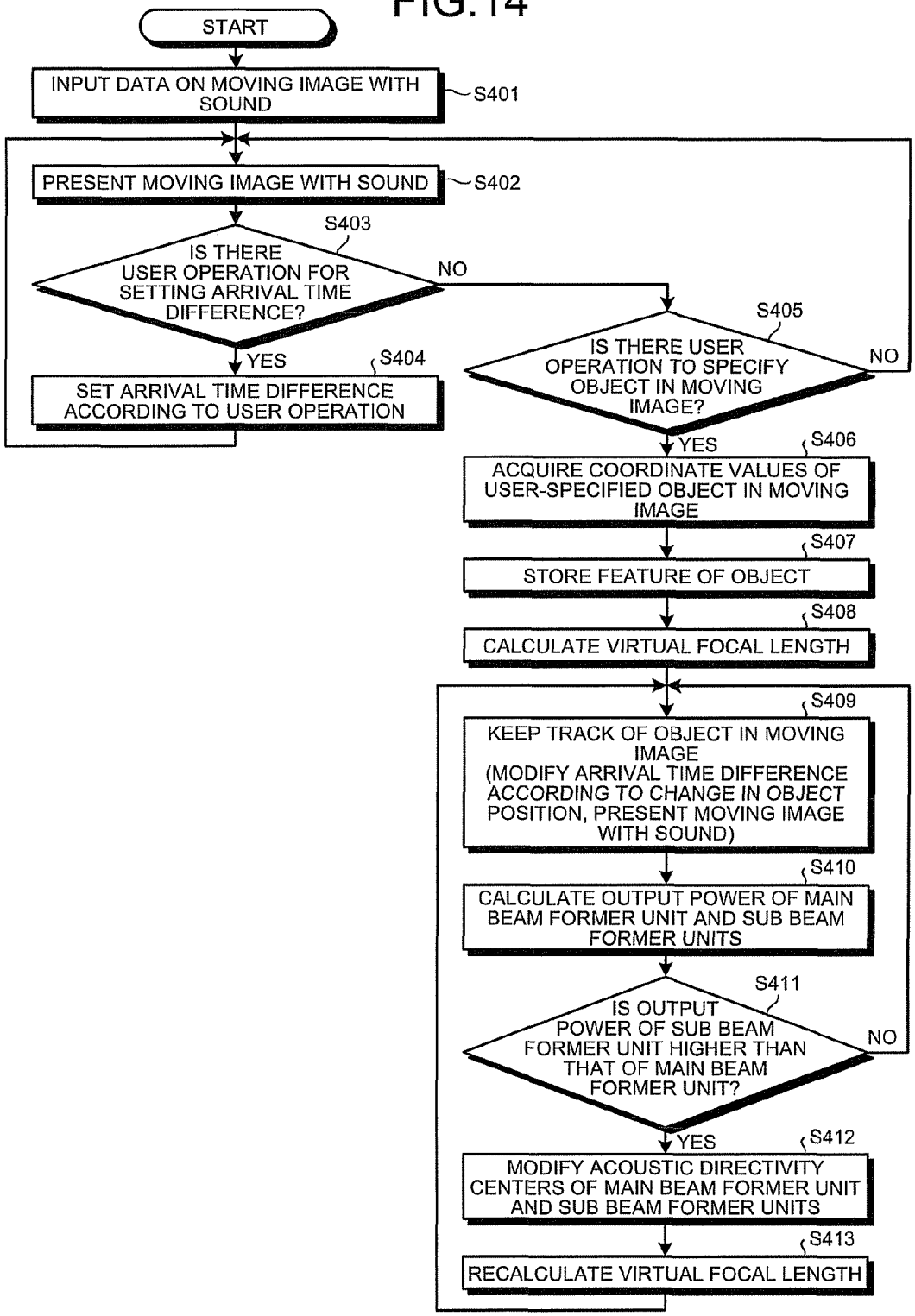
FIG. 14 is a flowchart showing the procedure of processing to be performed by the apparatus for presenting a moving image with sound according to the fourth embodiment.

FIG. 14 is a flowchart showing the procedure of basic processing of the apparatus for presenting a moving image with sound according to the present embodiment. Like the processing shown in the flowchart of FIG. 12, the series of processing shown in the flowchart of FIG. 14 is started when, for example, the user 24 makes an operation input to give an instruction to read a moving image with sound. The processing continues until the user 24 stops, fast-forwards, rewinds, or makes a cue or the like to the data on the moving image with sound under reproduction or until the data on the moving image with sound reaches its end. Since the processing of steps S401 to S409 in FIG. 14 is the same as that of steps S301 to S309 in FIG. 12, a description thereof will be omitted.

In the present embodiment, the object tracking unit 7 keeps track of the object specified by the user 24 in the moving image displayed on the display unit 12 and modifies the arrival time difference T when needed. In such a state, the recalibration unit 10 calculates the output power of the main beam former unit 3 and that of the sub beam former units 8 and 9 (step S410), and compares the beam former units 3, 8, and 9 in output power (step S411). If the output power of either one of the sub beam former units 8 and 9 is detected to be higher than that of the main beam former unit 3 (step S411: Yes), the recalibration unit 10 makes the acoustic directivity center of the main beam former unit 3 the same as that of the sub beam former unit of the highest power. The recalibration unit 10 also re-sets the acoustic directivity centers of the two sub beam former units 8 and 9 off the new acoustic directivity center of the main beam former unit 3 by ΔT in respective directions (step S412). The recalibration unit 10 then recalculates the calibration parameter (virtual focal length f') on the basis of the new acoustic directivity center (i.e., arrival time difference T) of the main beam former unit 3 (step S413).

As has been described above, the apparatus for presenting a moving image with sound according to the present embodiment is configured such that the recalibration unit 10 compares the output power of the main beam former unit 3 with that of the sub beam former units 8 and 9. If the output power of either one of the sub beam former units 8 and 9 is higher than that of the main beam former unit 3, the recalibration unit 10 shifts the acoustic directivity center of the main beam former unit 3 so as to be the same as that of the sub beam former unit of the higher output power. Based on the new acoustic directivity center, i.e., new arrival time difference T of the main beam former unit 3, the recalibration unit 10 then recalculates the calibration parameter (virtual focal length f') corresponding to the new arrival time difference T. Consequently, even if a change occurs in zooming during the shooting of the moving image with sound, it is possible to acoustically detect the change in zooming and automatically adjust the calibration parameter (virtual focal length f'), so as to continue keeping track of the object specified by the user 24.

Fifth Embodiment

Next, an apparatus for presenting a moving image with sound according to a fifth embodiment will be described. The apparatus for presenting a moving image with sound according to the present embodiment has the function of mixing the directional sound Sb generated by the main beam former unit 3 with the original stereo sounds Sl and Sr. The function allows the user 24 to adjust the mixing ratio of the directional sound Sb with the stereo sounds Sl and Sr (i.e., the degree of enhancement of the directional sound Sb).

Figure 15:
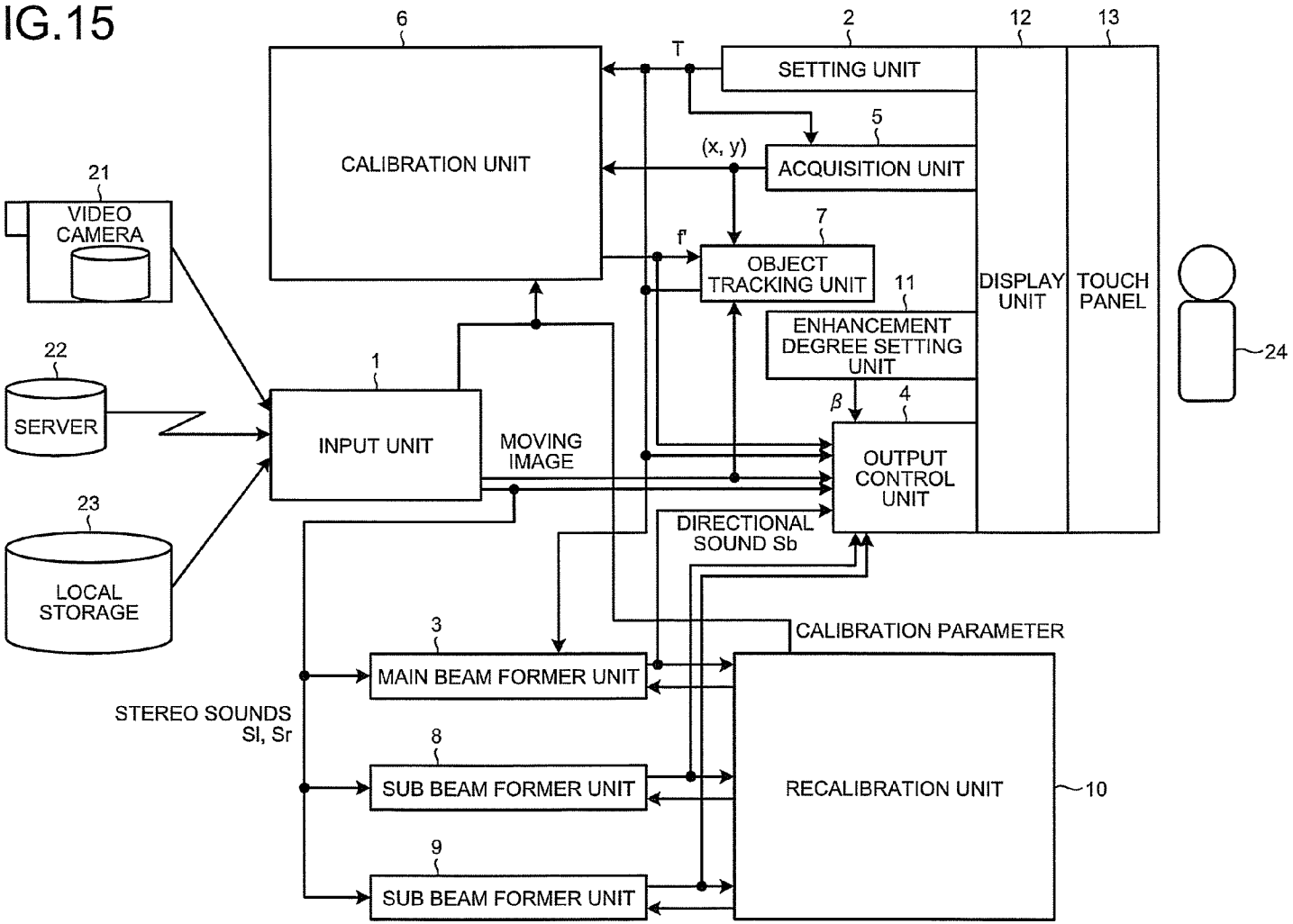
FIG. 15 is a functional block diagram of an apparatus for presenting a moving image with sound according to a fifth embodiment.

FIG. 15 shows the functional block configuration of the apparatus for presenting a moving image with sound according to the present embodiment. The apparatus for presenting a moving image with sound according to the present embodiment includes an enhancement degree setting unit 11 which is added to the configuration of the apparatus for presenting a moving image with sound according to the foregoing fourth embodiment. In other respects, the configuration is the same as in the first to fourth embodiments. Hereinafter, the same components as those of the first to fourth embodiments will thus be designated by like reference numerals, and a redundant description will be omitted. The following description will deal with the characteristic configuration of the present embodiment.

Figure 16:
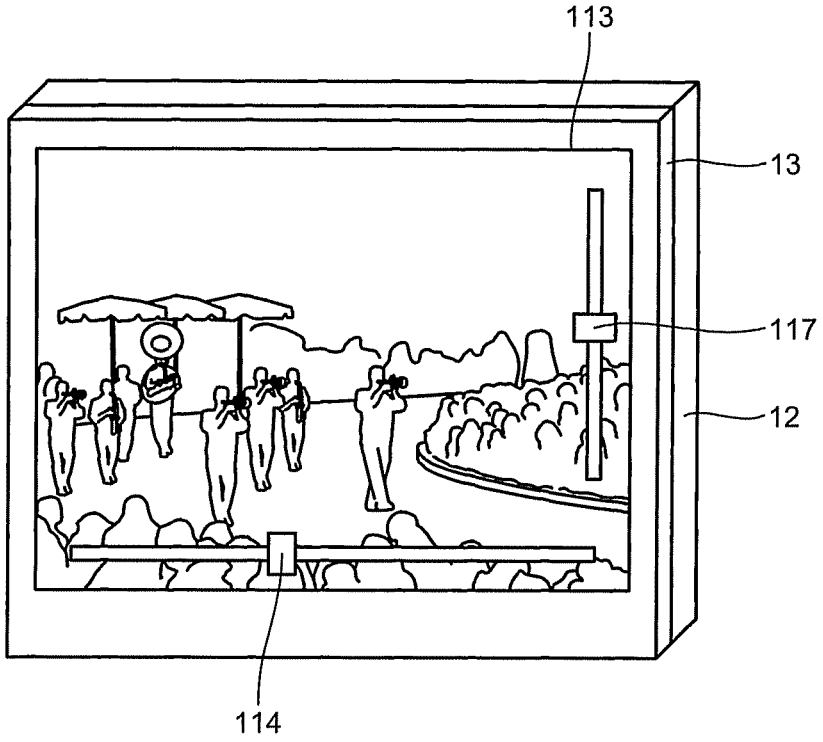
FIG. 16 is a diagram showing an example of a user interface.

The enhancement degree setting unit 11 sets the degree β of enhancement of the directional sound Sb generated by the main beam former unit 3 according to an operation that the user 24 makes, for example, from the touch panel 13. Specifically, for example, as shown in FIG. 16, a slide bar 117 is displayed on the display screen 113 of the display unit 12 aside from the slide bar 114 that the user 24 operates to set the arrival time difference T. When adjusting the degree β of enhancement of the directional sound Sb, the user 24 touches the touch panel 13 to slide the slide bar 117 displayed on the display screen 113. The enhancement degree setting unit 11 sets the degree β of enhancement of the directional sound Sb according to the operation of the user 24 on the slide bar 117. β can be set within the range of $0 \leq \beta \leq 1$.

In the apparatus for presenting a moving image with sound according to the present embodiment, when the degree β of enhancement of the directional sound Sb is set by the enhancement degree setting unit 11, the output control unit 4 mixes the directional sound Sb with the stereo sounds 51 and Sr with weights to produce output sounds according to the β setting. Assuming that the output sounds (stereo output sounds) to be output from the output control unit 4 are Ol and Or, the output sound Ol is determined by equation (14) seen below, and the output sound Or is determined by equation (15) seen below. Since the output control unit 4 presents the output sounds Ol and Or that are determined on the basis of β set by the enhancement degree setting unit 11, the user 24 can listen to the directional sound Sb that is enhanced by the desired degree of enhancement.

$$Ol=\beta\cdot Sb+(1-\beta)\cdot Sl \quad (14)$$

$$Or=\beta\cdot Sb+(1-\beta)\cdot Sr \quad (15)$$

In order that the user 24 can watch and listen to the moving image with sound without a sense of strangeness, the delay of the directional sound Sb occurring in the main beam former unit 3 is compensated so that the moving image and the output sounds Ol and Or are output from the output control unit 4 in synchronization with each other. Hereinafter, specific configuration for compensating the delay occurring in the main beam former unit 3 and appropriately presenting the directional sound Sb with the moving image will be described.

Figure 17:
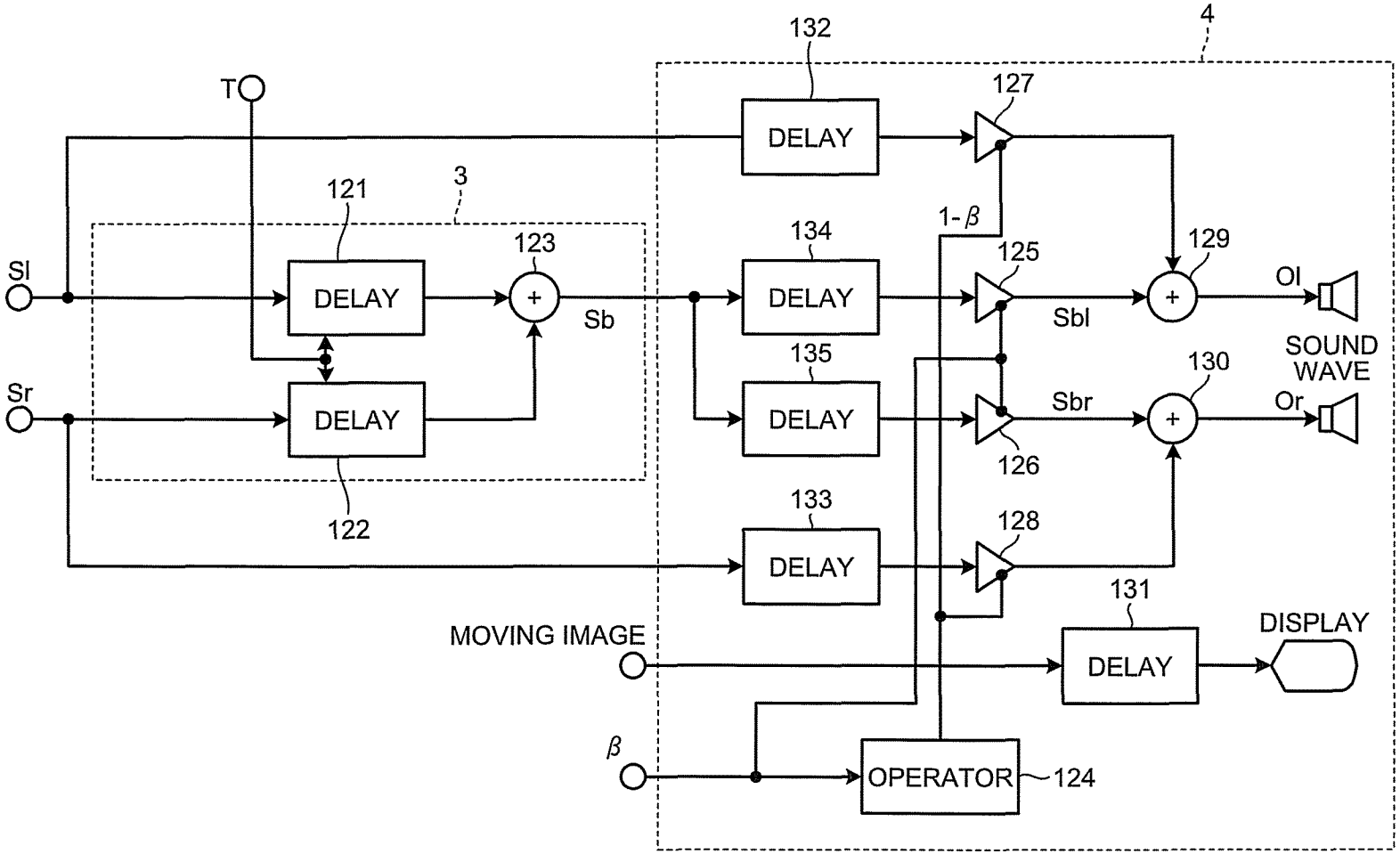
FIG. 17 is a block diagram showing a specific example of the configuration of a main beam former unit and an output control unit.

FIG. 17 is a block diagram showing a specific example of the configuration of the main beam former unit 3 and the output control unit 4, where the main beam former unit 3 is composed of a delay-sum array. The stereo sounds Sl and Sr that are included in the moving image with sound input to the input unit 1 (the sound Sl recorded by the microphone 101 and the sound Sr recorded by the microphone 102 of the imaging apparatus) are input to the main beam former unit 3 which is composed of a delay-sum array. The sound 51 and the sound Sr are delayed by delay devices 121 and 122, respectively, so as to be in phase. The in-phase sounds Sl and Sr are added by an adder 123 into a directional sound Sb. If the source of the sound to enhance is closer to the microphone 101, the arrival time difference T has a negative value. If the source of the sound to enhance is closer to the microphone 102, the arrival time difference T has a positive value. The main beam former unit 3 receives the arrival time difference T set by the setting unit 2, and sets the amount of delay of the delay device 121 to 0.5(Tm'−T) and the amount of delay of the delay device 122 to 0.5(Tm'+T) for operation. Such distribution of the amounts of delay by 0.5T across 0.5Tm' makes it possible to maintain the arrival time difference T between the original sounds Sl and Sr, and delay the directional sound Sb by 0.5Tm' with respect to the original sounds Sl and Sr.

The output control unit 4 delays the directional sound Sb by 0.5(Tm'+T) with a delay device 134 and by 0.5(Tm'−T) with a delay device 135, thereby giving the same arrival time difference T that the two delay outputs originally had. The output control unit 4 further inputs the degree β of enhancement of the directional sound Sb (0≤β≤1), and calculates the value of 1−β from β by using an operator 124. The output control unit 4 multiplies the output sounds of the delay devices 134 and 135 by β times to generate Sbl and Sbr, using multipliers 125 and 126. Consequently, Sbl and Sbr lag behind the original stereo sounds Sl and Sr by Tm'. The output control unit 4 then delays the sound Sl by Tm' with a delay device 132, multiplies the resultant by (1−β) times with a multiplier 127, and adds the resultant and Sbl by an adder 129 to obtain the output sound Ol. Similarly, the output control unit 4 delays the sound Sr by Tm' with a delay device 133, multiplies the resultant by (1−β) times with a multiplier 128, and adds the resultant and Sbr by an adder 130 to obtain the output sound Or. When β=0, Ol and Or coincide with Sbl and Sbr. When β=1, Ol and Or coincide with the delayed Sl and Sr. Finally, the output control unit 4 delays the moving image by Tm' with a delay device 131, thereby maintaining synchronization with the output sounds Ol and Or.

Figure 18:
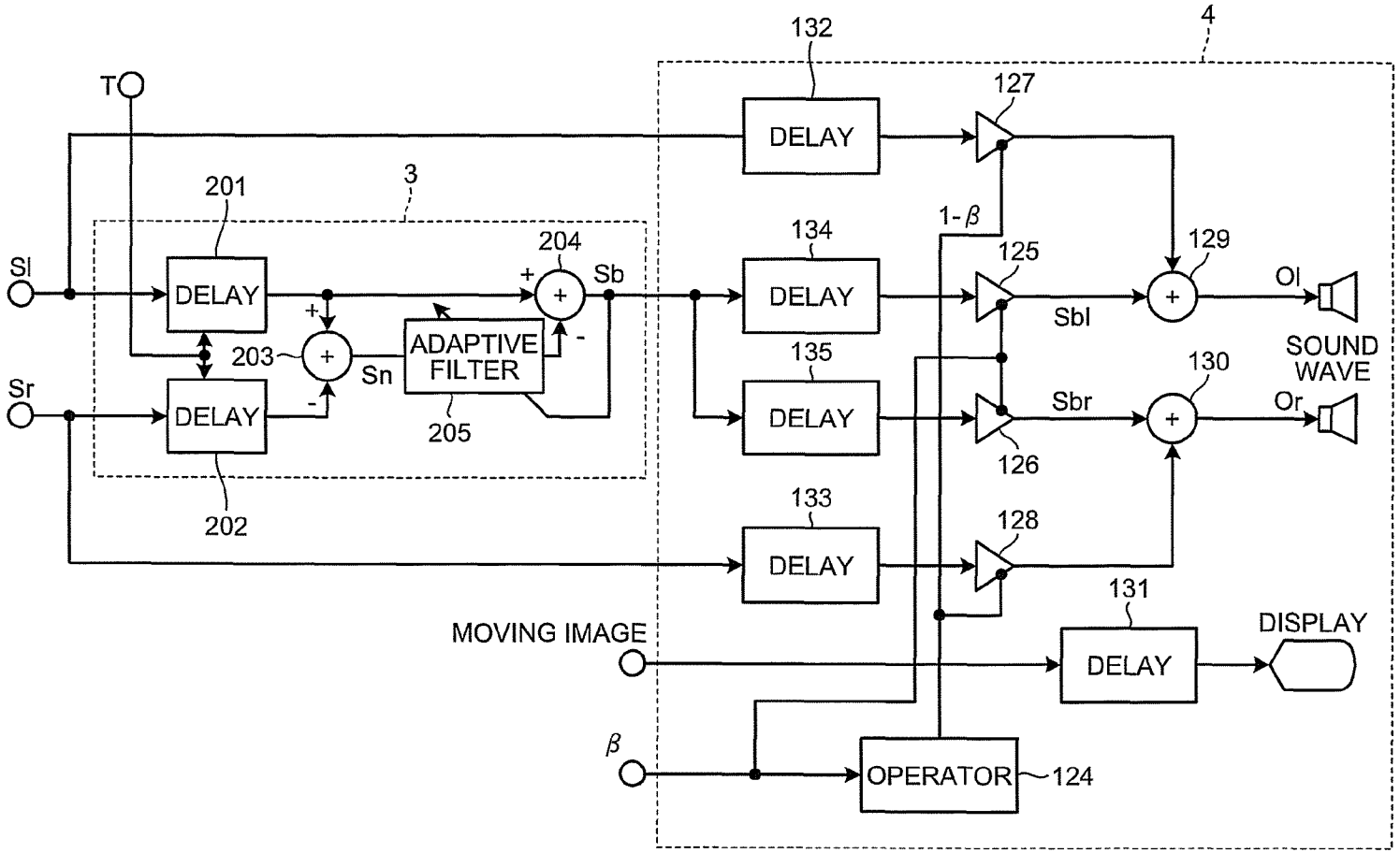
FIG. 18 is a block diagram showing a specific example of the configuration of a main beam former unit and an output control unit.

FIG. 18 is a block diagram showing a specific example of the configuration of the main beam former unit 3 and the output control unit 4, where the main beam former unit 3 is composed of a Griffith-Jim adaptive array. The output control unit 4 has the same internal configuration as the configuration example shown in FIG. 17.

The main beam former unit 3 implemented as a Griffith-Jim adaptive array includes delay devices 201 and 202, subtractors 203 and 204, and an adaptive filter 205. The main beam former unit 3 sets the amount of delay of the delay device 201 to 0.5(Tm'−T) and the amount of delay of the delay device 202 to 0.5(Tm'+T), i.e., with 0.5Tm' at the center. This makes the sound Sl and the sound Sr in-phase in the directions given by the arrival time difference T, so that a differential signal Sn resulting from the subtractor 203 contains only noise components without the sound in the directions. The coefficients of the adaptive filter 205 are adjusted to minimize the correlation between the output signal Sb and the noise components Sn. The adjustment is made by a well-known adaptive algorithm such as the steepest descent method and the stochastic gradient method. Consequently, the main beam former unit 3 can form sharper acoustic directivity than with the delay-sum array. Even when the main beam former unit 3 is thus implemented as an adaptive array, the output control unit 4 can synchronize the output sounds Ol and Or with the moving image in the same manner as with the delay-sum array.

The configurations of the main beam former unit 3 and the output control unit 4 shown in FIGS. 17 and 18 are also applicable to the apparatuses for presenting a moving image with sound according to the foregoing first to fourth embodiments. In such cases, β to be input to the output control unit 4 has an appropriate value. According to the fourth embodiment and the present embodiment, the outputs of the sub beam former units 8 and 9 may be used as the output sounds Ol and Or instead of the weighted sums of the original stereo sounds Sl and Sr and the directional sounds Sbl and Sbr being used as the output sounds Ol and Or as described above. In such cases, it is preferable that the user 24 can select which to use as the output sounds Ol and Or, the weighted sums of the original stereo sounds Sl and Sr and the directional sounds Sbl and Sbr or the outputs of the sub beam former units 8 and 9.

The foregoing implementation of the main bean former unit 3 based on the delay-sum array or adaptive array is similarly applicable to the sub beam former units 8 and 9. In such a case, the only difference lies in that the sub beam former units 8 and 9 use the values T−ΔT and T+ΔT instead of the value T.

As has been described above, the apparatus for presenting a moving image with sound according to the present embodiment is configured to mix the directional sound Sb generated by the main beam former unit 3 with the original stereo sounds Sl and Sr. The user 24 can adjust the mixing ratio of the directional sound Sb with the stereo sounds Sl and Sr (i.e., the degree of enhancement of the directional sound Sb). This makes it possible for the user 24 to listen to the directional sound Sb that is enhanced to the desired degree of enhancement.

User Interface

The apparatuses for presenting a moving image with sound according to the first to fifth embodiments have been described. A user interface through which the user 24 sets the arrival time difference T, specifies an object (subject) in the moving image, sets the degree of enhancement, etc., is not limited to the ones described in the foregoing embodiments.

The apparatuses for presenting a moving image with sound according to the foregoing embodiments need to have operation parts for the user 24 to operate when watching and listening to a moving image with sound. Examples of the operation parts include a play button from which the user 24 gives an instruction to reproduce (play) the moving image with sound, a pause button to temporarily stop a play, a stop button to stop a play, a fast forward button to fast forward, a rewind button to rewind, and a volume control to adjust the sound level. The user interface is preferably integrated with such operation parts. Hereinafter, a specific example will be given of a user interface screen that is suitable for the user interface of the apparatuses for presenting a moving image with sound according to the foregoing embodiments.

Figure 19:
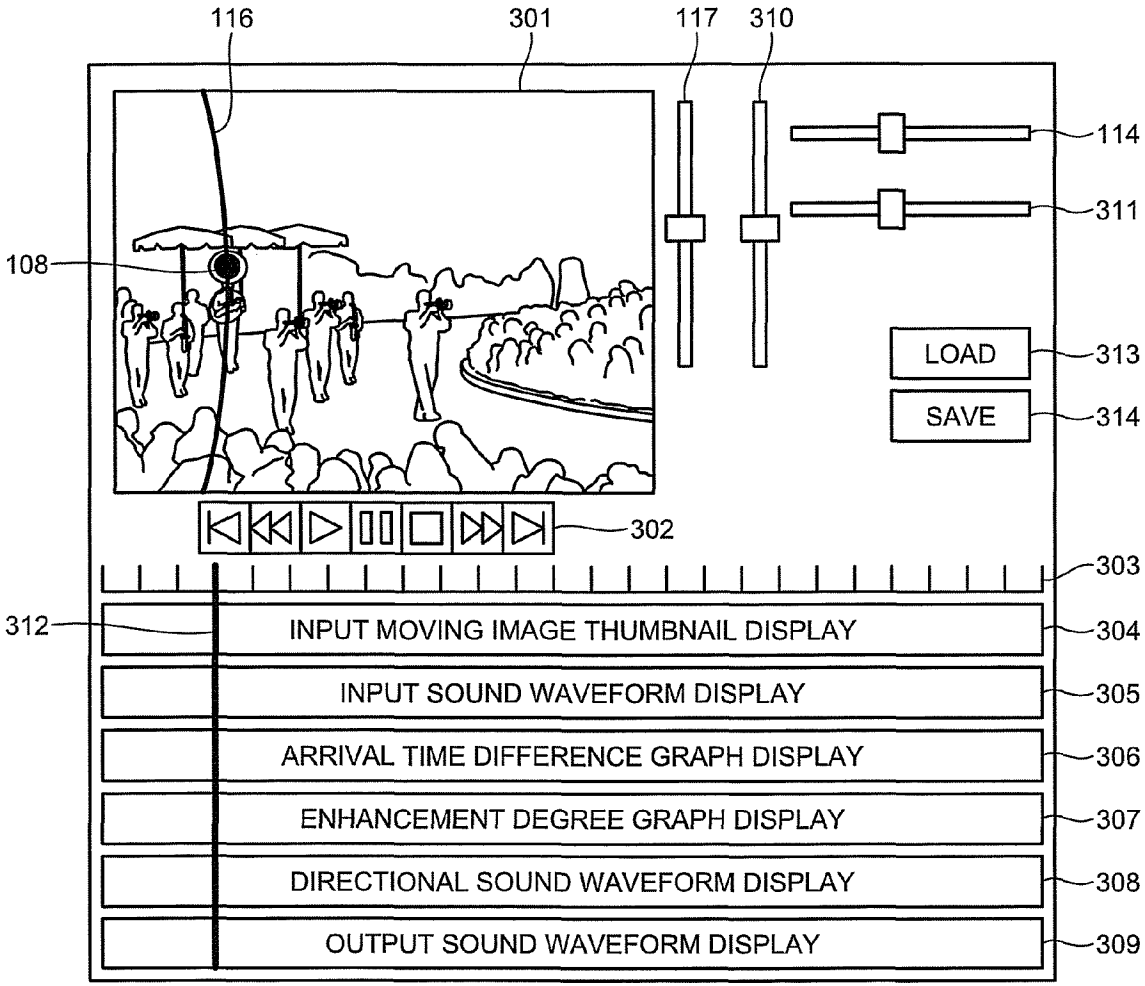
FIG. 19 is a diagram showing a specific example of a user interface screen that is suitable for a user interface.

FIG. 19 is a diagram showing a specific example of the user interface screen that the user 24 can operate by means of the touch panel 13 and other pointing devices such as a mouse. The reference numeral 301 in the diagram designates the moving image that is currently displayed. The user 24 operates a play controller 302 to make operations such as a play, pause, stop, fast forward, rewind, jump to the top, and jump to the end on the moving image displayed. The acoustic directivity center mark 116 described above and an icon or the like that indicates the position of the subject image 108 can be displayed as superimposed on the moving image 301 when available.

The reference numeral 114 in the diagram designates a slide bar for the user 24 to operate to set the arrival time difference T. The reference numeral 117 in the diagram designates a slide bar for the user 24 to operate to set the degree β of enhancement of the directional sound Sb. The reference numeral 310 in the diagram designates a slide bar for the user 24 to operate to adjust the sound level of the output sounds Ol and Or output from the output control unit 4. The reference numeral 311 in the diagram designates a slide bar for the user 24 to operate to adjust the virtual microphone-to-microphone distance d'. The provision of the slide bar 311 allows the user 24 to adjust the virtual microphone-to-microphone distance d' by himself/herself by operating the slide bar 311 in situations such as when the current virtual microphone-to-microphone distance d' seems to be smaller than the actual microphone-to-microphone distance d. After the user 24 operates the slide bar 311 to modify the virtual microphone-to-microphone distance d', the value of the virtual focal length f' consistent with the new value of the microphone-to-microphone distance d' is recalculated by the foregoing equation (12) or equation (13). Here, the latest values of x1 and y1 and the value of the arrival time difference T that are used and recorded by the calibration unit 6 or the recalibration unit 10 when calculating the virtual focal length f' are substituted into the foregoing equation (12) or equation (13). Using the foregoing equation (6), the theoretical maximum value Tm' of the arrival time difference T is also recalculated for the new d'.

The reference numeral 303 in the diagram designates a time display which shows the time from the top to the end of the data on the moving image with sound input by the input unit 1 from left to right with the start time at 0. The reference numeral 304 in the diagram designates an input moving image thumbnail display which shows thumbnails of the moving image section of the data on the moving image with sound input by the input unit 1 from left to right in time order. The reference numeral 305 in the diagram designates an input sound waveform display which shows the waveforms of respective channels of the sound section of the data on the moving image with sound input by the input unit 1 from left to right in time order, with the channels in rows. The input sound waveform display 305 is configured such that the user 24 can select thereon two channels to use if the data on the moving image with sound includes three or more sound channels.

The reference numeral 306 in the diagram designates an arrival time difference graph display which provides a graphic representation of the value of the arrival time difference T to be set to the main beam former unit 3 from left to right in time order. The reference numeral 307 in the diagram designates an enhancement degree graph display which provides a graphic representation of the value of the degree β of enhancement of the directional sound Sb to be set to the output control unit 4 from left to right in time order. As mentioned previously, the user 24 can set the arrival time difference T and the degree β of enhancement of the directional sound Sb arbitrarily by operating the slide bar 114 and the slide bar 117. The user interface screen is configured such that the arrival time difference T and the degree β of enhancement of the directional sound Sb can also be set on the arrival time difference graph display 306 and the enhancement degree graph display 307.

Figure 20A:
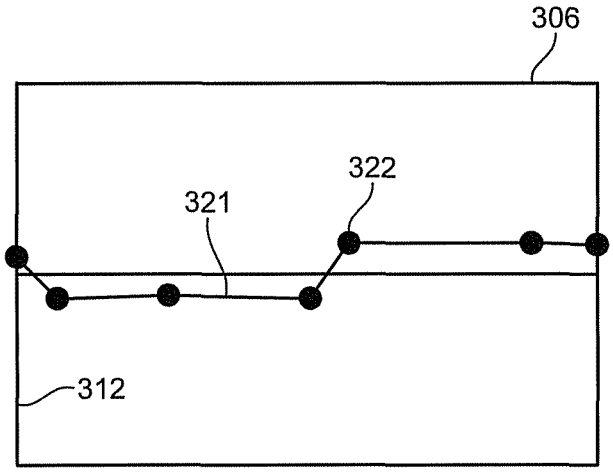
FIGS. 20A and 20B are diagrams showing an example where the arrival time difference is set on an arrival time difference graph display.
Figure 20B:
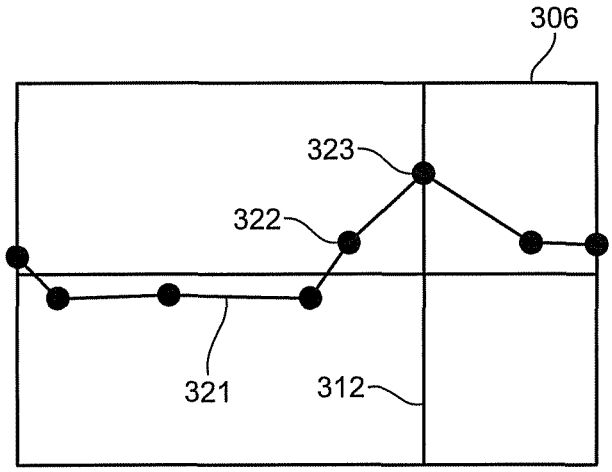

FIGS. 20A and 20B are diagrams showing an example of setting of the arrival time difference T on the arrival time difference graph display 306. As shown in FIGS. 20A and 20B, the arrival time difference graph display 306 expresses the graph with a plurality of control points 322 which are arranged in time series and interval curves 321 which connect adjoining control points. Initially, the graph is expressed by a single interval curve with control points at the start time and the end time. The user 24 can intuitively edit the shape of the graph of the arrival time difference T, for example, from FIG. 20A to FIG. 20B by double clicking on a desired time on the graph to add a control point (323 in FIG. 20B) to the graph and dragging a desired control point. While FIGS. 20A and 20B show an example of setting the arrival time difference T on the arrival time difference graph display 306, the degree β of enhancement of the directional sound Sb may be set by operations similar to the case of setting the arrival time difference T since the enhancement degree graph display 307 is also expressed in a graph form like the arrival time difference graph display 306.

Return to the description of the user interface screen in FIG. 19. The reference numeral 308 in the diagram designates a directional sound waveform display which shows the waveform of the directional sound Sb output by the main beam former unit 3 from left to right in time order. The reference numeral 309 in the diagram designates an output sound waveform display which shows the waveforms of the output sounds Ol and Or output by the output control unit 4 from left to right in time order, with the waveforms in rows.

In the user interface screen of FIG. 19, the time display 303, the input moving image thumbnail display 304, the input sound waveform display 305, the arrival time difference graph display 306, the enhancement degree graph display 307, the directional sound waveform display 308, and the output sound waveform display 309 are displayed so that their respective horizontal positions on-screen are in time with each other. A time designation bar 312 for indicating the time t of the currently-displayed moving image is displayed as superimposed. The user 24 can move the time designation bar 312 to the right and left to designate a desired time t for the cueing of the moving image and sound. The play controller 302 can be operated from the cue position to repeat watching and listening to the moving image and sound while adjusting the arrival time difference T, the coordinate values (x1, y1) of the object, the degree β of enhancement of the directional sound Sb, the virtual microphone-to-microphone distance d', and the like in the above-described manner.

The reference numeral 313 in the diagram designates a load button for making the apparatus for presenting a moving image with sound according to each of the foregoing embodiments read desired data including data on a moving image with sound. The reference numeral 314 designates a save button for making the apparatus for presenting a moving image with sound according to each of the foregoing embodiments record and store desired data including the directional sound Sb into a recording medium (such as the local storage 23). When the user 24 presses such buttons, an interface screen shown in FIG. 21 appears.

An interface screen shown in FIG. 21 will be described. The reference numeral 401 in the diagram designates the window of the interface screen. The reference numeral 402 in the diagram designates a sub window for listing data files. The user 24 can select a desired data file by tapping on a data file name displayed on the sub window 402. The reference numeral 403 in the diagram designates a sub window for displaying the selected data file name or entering a new data file name.

The reference numeral 404 in the diagram designates a pull-down menu for selecting the data type to list. When a data type is selected, data files of that type are exclusively listed in the sub window 402. The reference numeral 405 in the diagram designates an OK button for performing an operation of storing or reading the selected data file. The reference numeral 406 in the diagram designates a cancel button for quitting the operation and terminating the interface screen 401.

Figure 21:
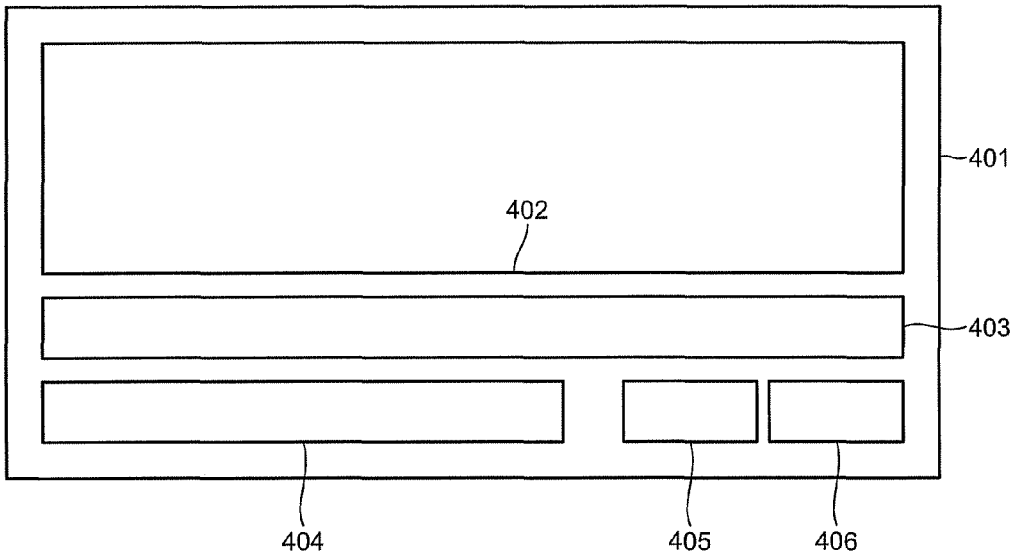
FIG. 21 is a diagram showing an example of an interface screen for storing and reading data.

To read data on a moving image with sound, the user 24 initially presses the load button 313 on the user interface screen of FIG. 19 so that the window 401 of the interface screen in FIG. 21 appears in read mode. The user 24 selects data type "moving image with sound" from the pull-down menu 404. As a result, the sub window 402 displays a list of files of moving images with sound that are readable. The file of a desired moving image with sound is selected from the list, whereby the data on the moving image with sound can be read.

To store the directional sound Sb of a moving image with sound that is currently viewed, the user 24 initially presses the save button 314 on the user interface screen of FIG. 19 so that the window 401 of the interface screen in FIG. 21 appears in recording and storing mode. The user 24 selects data type "directional sound Sb" from the pull-down menu 404. The directional sound Sb, the result of processing, can be recorded and stored by entering a data file name into the sub window 403. Otherwise, a project file that contains all information such as the moving image, sounds, and parameters for the apparatus for presenting a moving image with sound to use may be recorded, stored, and read, so that the user 24 can suspend and resume operations any time.

The use of the interface screen shown in FIG. 21 makes it possible to selectively read, record, and store the following data. That is, the interface screen shown in FIG. 21 can be used to record the directional sound Sb and the output sounds Ol and Or on a recording medium. This allows the user 24 to use the directional sound Sb and the output sounds Ol and Or generated from the input data on the moving image with sound any time. The directional sound Sb, the output sounds Ol and Or, and the moving image can be edited into and recorded as synchronized data on a moving image with sound. This allows the user 24 to use secondary products that are made of the input moving image data plus the directional sound Sb and output sounds Ol and Or any time.

The interface screen shown in FIG. 21 can be used to record the virtual microphone-to-microphone distance d', the virtual focal length f', the arrival time difference T, the coordinate values (x1, y1) of the object, the degree β of enhancement of the directional sound Sb, the numbers of the used channels, and the like on a recording medium. This allows the user 24 to use the information for generating the output sounds with acoustic directivity from the input data on the moving image with sound any time. Such a recording function corresponds to the recording and storing of a project file mentioned above. The information can also be edited into and recorded as data on a moving image with sound. Specifically, the virtual microphone-to-microphone distance d', the virtual focal length f', the arrival time difference T, the coordinate values (x1, y1) of the object, the degree β of enhancement of the directional sound Sb, the numbers of the used channels, and the like are recorded into a dedicated track that is provided in the data on the moving image with sound. This allows the user 24 to use any time second products of the data on the input moving image with sound in which the information for generating the output sounds is embedded.

The interface screen shown in FIG. 21 can be used to read the virtual microphone-to-microphone distance d', the virtual focal length f', the arrival time difference T, the coordinate values (x1, y1) of the object, the degree β of enhancement of the directional sound Sb, the numbers of the used channels, and the like that are recorded and stored into a recording medium, from the recording medium. This allows the user 24 to suspend and resume viewing easily when combined with the foregoing recording function. Such a reading function corresponds to the reading of a project file mentioned above. The types of data or information to be recorded and stored into a recording medium or read from a recording medium can be all distinguished by selecting a data type from the pull-down menu 404.

Program for Presenting Moving Image with Sound

Figure 22:
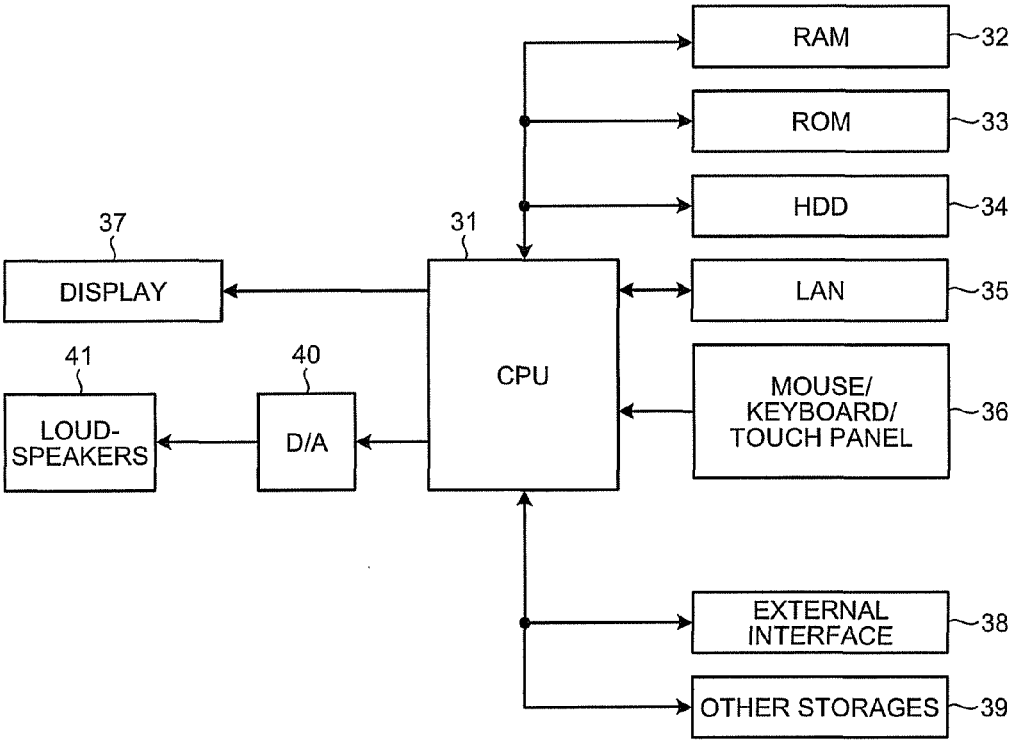
FIG. 22 is a diagram showing an example of the configuration of a computer system.

The apparatuses for presenting a moving image with sound according to the foregoing embodiments can be implemented by installing a program for presenting a moving image with sound that is intended to implement the processing of the units described above (such as the input unit 1, the setting unit 2, the main beam former unit 3, and the output control unit 4) on a general purpose computer system. FIG. 22 shows an example of the configuration of the computer system in such a case.

The computer system stores the program for presenting a moving image with sound in a HDD 34. The program is read into a RAM 32 and executed by a CPU 31. The computer system may be provided with the program for presenting a moving image with sound via a recording medium that is loaded into other storages 39, or from another device that is connected through a LAN 35. The computer system can accept operation inputs from the user 24 and present information to the user 24 by using a mouse/keyboard/touch panel 36, a display 37, and a D/A converter 40.

The computer system can acquire data on a moving image with sound and other data from a movie camera that is connected through an external interface 38 such as USB, a server that is connected at the end of a communication channel through the LAN 35, and the HDD 34 and other storages 39. Examples of the other data include data for generating output sounds Ol and Or, such as the virtual microphone-to-microphone distance d', the virtual focal length f', the arrival time difference T, the coordinate values (x1, y1) of the object, the degree β of enhancement of the directional sound Sb, and the numbers of the used channels. The data on a moving image with sound acquired from other than the HDD 34 is once recorded on the HDD 34, and read into the RAM 32 when needed. The read data is processed by the CPU 31 according to operations made by the user 24 through the mouse/keyboard/touch panel 36, and the moving image is output to the display 37 and the directional sound Sb and output sounds Ol and Or are output to the D/A converter 40. The D/A converter 40 is connected to loudspeakers 41 and the like, whereby the directional sound Sb and the output sounds Ol and Or are presented to the user 24 in the form of sound waves. The generated directional sound Sb and output sounds Ol and Or, and the data such as the virtual microphone-to-microphone distance d', the virtual focal length f', the arrival time difference T, the coordinate values (x1, y1) of the object, the degree β of enhancement of the directional sound Sb, and the numbers of the used channels are recorded and stored into the HDD 34, other storages 39, etc.

Modification

The apparatuses for presenting a moving image with sound according to the foregoing embodiments have dealt with the cases where, for example, two channels of sounds selected from a plurality of channels of simultaneously recorded sounds are processed to generate a directional sound Sb so that the moving image and the directional sound Sb can be watched and listened to together. With n channels of simultaneously recorded sounds, the apparatuses may be configured so that the setting unit 2 sets arrival time differences T1 to Tn−1 for (n−1) channels with respect to a single referential channel according to the operation of the user 24. This makes it possible to generate a desired directional sound Sb from three or more channels of simultaneously recorded sounds, and present it along with the moving image.

Take, for example, a teleconference system with distributed microphones where the sound in an entire conference space is recorded by a small number of microphones with microphone-to-microphone distances as large as 1 to 2 m. Even in such a case, it is possible to construct a teleconference system in which the user 24 can operate his/her controller or the like to set arrival time differences T so that the speech of a certain speaker at the other site can be heard with enhancement.

As has been described above, according to the apparatuses for presenting a moving image with sound according to the embodiments, the arrival time difference T is set on the basis of the operation of the user 24, and the directional sound Sb in which the sound having the set arrival time difference T is enhanced is generated and presented to the user 24 along with the moving image. Consequently, even with a moving image with sound in which the information on the focal length of the imaging apparatus at the time of shooting and the information on the microphone-to-microphone distance are unknown, the user 24 can enhance the sound issued from a desired subject in the moving image, and watch and listen to the moving image and the sound together.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An apparatus for presenting a moving image with sound, comprising:

a memory that has stores computer executable units; and a processor configured to execute the computer executable units stored in the memory;

an input unit, stored in the memory and executed by the processor, that inputs data on a moving image with sound including a moving image and a plurality of channels of sounds;

a setting unit, stored in the memory and executed by the processor, that:

receives an operational input from a user, the operational input indicating an arrival time difference, the arrival time difference being a difference in time between a plurality of channels of sounds coming from a desired direction; and sets the arrival time difference based on the operational input;

a main beam former unit that generates a directional sound in which a sound in a direction having the arrival time difference set by the setting unit is enhanced, from the plurality of channels of sounds included in the data on the moving image with sound; and an output control unit that outputs the directional sound along with the moving image.

2. The apparatus according to claim 1, further comprising:

an acquisition unit, stored in the memory and executed by the processor, that acquires position coordinates of an object specified as a source of the enhanced sound in the moving image output along with the directional sound; and a calibration unit, executed by the processor, that calculates a calibration parameter which defines relationship between the position coordinates acquired by the acquisition unit and the arrival time difference set by the setting unit.

3. The apparatus according to claim 2, further comprising an object tracking unit, stored in the memory and executed by the processor, that keeps track of the object in the moving image, and modifies the arrival time difference by using the calibration parameter so that the direction of the sound to enhance continues being directed to the object.

4. The apparatus according to claim 2, further comprising:

a sub beam former unit that generates a sound in which a sound in a direction, a predetermined amount off the direction of the sound enhanced by the main beam former unit, is enhanced; and a recalibration unit that compares output power of the directional sound and output power of the sound generated by the sub beam former unit, and if the output power of the sound generated by the sub beam former unit is higher than that of the directional sound, shifts the direction of the sound to be enhanced by the main beam former unit by the predetermined amount and recalculates the calibration parameter.

5. The apparatus according to claim 3, further comprising:

a sub beam former unit that generates a sound in which a sound in a direction, a predetermined amount off the direction of the sound enhanced by the main beam former unit, is enhanced; and a recalibration unit that compares output power of the directional sound and output power of the sound generated by the sub beam former unit, and if the output power of the sound generated by the sub beam former unit is higher than that of the directional sound, shifts the direction of the sound to be enhanced by the main beam former unit by the predetermined amount and recalculates the calibration parameter.

6. The apparatus according to claim 2, wherein the output control unit outputs a mark as superimposed on the moving image, the mark indicating a range of directions of the sound that the main beam former unit enhances.

7. The apparatus according to claim 3, wherein the output control unit outputs a mark as superimposed on the moving image, the mark indicating a range of directions of the sound that the main beam former unit enhances.

8. The apparatus according to claim 4, wherein the output control unit outputs a mark as superimposed on the moving image, the mark indicating a range of directions of the sound that the main beam former unit enhances.

9. A method for presenting a moving image with sound, comprising:

inputting data on a moving image with sound including a moving image and a plurality of channels of sounds;

receiving an operational input from a user, the operational input indicating an arrival time difference, the arrival time difference being a difference in time between a plurality of channels of sounds coming from a desired direction;

setting the arrival time difference based on the operational input;

generating a directional sound in which a sound in a direction having the set arrival time difference is enhanced, from the plurality of channels of sounds included in the data on the moving image with sound; and outputting the directional sound along with the moving image.

10. A program product having a non-transitory computer readable medium including programmed instructions for presenting a moving image with sound, wherein the instructions, when executed by a computer, cause the computer to perform:

inputting data on a moving image with sound including a moving image and a plurality of channels of sounds;

receiving an operational input from a user, the operational input indicating an arrival time difference, the arrival time difference being a difference in time between a plurality of channels of sounds coming from a desired direction;

setting the arrival time difference based on the operational input;

generating a directional sound in which a sound in a direction having the set arrival time difference is enhanced, from the plurality of channels of sounds included in the data on the moving image with sound; and outputting the directional sound along with the moving image.

* * * * *